US006312324B1

(12) United States Patent
Mitsui et al.

(10) Patent No.: US 6,312,324 B1
(45) Date of Patent: Nov. 6, 2001

(54) SUPERABRASIVE TOOL AND METHOD OF MANUFACTURING THE SAME

(75) Inventors: Kosuke Mitsui; Toshio Fukunishi; Kazunori Kadomura; Yukio Shimizu; Yoshio Kouta; Masaaki Yamanaka; Akio Hara, all of Sakai (JP)

(73) Assignee: Osaka Diamond Industrial Co., Sakai (JP)

( * ) Notice: Subject to any disclaimer, the term of this patent is extended or adjusted under 35 U.S.C. 154(b) by 0 days.

(21) Appl. No.: 09/077,024

(22) PCT Filed: Sep. 24, 1997

(86) PCT No.: PCT/JP97/03369

§ 371 Date: May 27, 1998

§ 102(e) Date: May 27, 1998

(87) PCT Pub. No.: WO98/14307

PCT Pub. Date: Apr. 9, 1998

(30) Foreign Application Priority Data

| | | |
|---|---|---|
| Sep. 30, 1996 | (JP) | 8-280227 |
| Jan. 28, 1997 | (JP) | 9-029537 |
| Jan. 28, 1997 | (JP) | 9-029538 |
| Feb. 24, 1997 | (JP) | 9-083223 |
| Apr. 18, 1997 | (JP) | 9-116090 |
| Jun. 10, 1997 | (JP) | 9-169593 |

(51) Int. Cl.[7] ..... B24D 3/00
(52) U.S. Cl. ..... 451/540; 451/550; 125/39
(58) Field of Search ..... 451/540, 550, 451/41; 125/30.01, 39

(56) References Cited

U.S. PATENT DOCUMENTS

| | | | | |
|---|---|---|---|---|
| 4,224,380 | * | 9/1980 | Bovenkerk et al. | 428/545 |
| 4,550,790 | * | 11/1985 | Link | 175/329 |
| 4,572,722 | * | 2/1986 | Dyer | 51/309 |
| 4,798,026 | * | 1/1989 | Cerceau | 51/204 |
| 4,923,490 | * | 5/1990 | Johnson et al. | 51/298 |
| 5,054,246 | * | 10/1991 | Phaal et al. | 51/204 |
| 5,151,107 | * | 9/1992 | Cho et al. | 51/295 |
| 5,190,568 | * | 3/1993 | Tselesin | 51/293 |
| 5,906,246 | * | 5/1999 | Mensa-Wilmot et al. | 175/432 |

* cited by examiner

*Primary Examiner*—Allen M. Ostrager
*Assistant Examiner*—William Hong
(74) *Attorney, Agent, or Firm*—W. F. Fasse; W. G. Fasse

(57) ABSTRACT

A superabrasive tool such as a superabrasive grindstone (101; 102), a superabrasive dresser (103; 104; 105) or a superabrasive lap surface plate (106) includes a base (20) of steel and a superabrasive layer (10) formed on the base (20). The superabrasive layer (10) includes superabrasive grains (11) consisting of diamond grains, cubic boron nitride grains or the like and a holding layer consisting of a nickel plating layer (16) and a bond layer (17), or a brazing filler metal layer (18), holding the superabrasive grains (11) and fixing the same onto the base (20). Grooves (12) or holes (14) are formed on flat surfaces (19) of the superabrasive grains (11) exposed from the holding layer (16, 17; 18). The holding layer (16, 17; 18) holding and fixing the superabrasive grains (11) so that the surfaces of the grains are partially exposed is formed on the base (20). The grooves (12) or the holes (14) are formed by irradiating the surfaces of the superabrasive grains (11) exposed from the holding layer (16, 17; 18) with a laser beam (50). Working of high accuracy can be performed by forming the grooves (12) or the holes (14) on the surfaces of the superabrasive grains (11).

25 Claims, 15 Drawing Sheets

SUPERABRASIVE TOOL AND METHOD OF MANUFACTURING THE SAME

FIELD OF THE INVENTION

The present invention generally relates to a superabrasive tool having a superabrasive layer holding superabrasive grains by a bond or the like and a method of manufacturing the same. More specifically, the present invention relates to a superabrasive tool such as a superabrasive grindstone, a superabrasive dresser or a superabrasive lap surface plate and a method of manufacturing the same. A grindstone employing superabrasive grains of diamond, cubic boron nitride (CBN) or the like can be cited as the superabrasive grindstone. As to the superabrasive dresser, a diamond rotary dresser utilized for dressing a conventional grindstone of WA or GC (type of JIS) or a vitrified bond CBN grindstone mounted on a grinder or the like in high accuracy can be cited. A diamond lap surface plate employed for lapping of a silicon wafer, ceramics, optical glass, cemented carbide, cermet or a metal material can be cited as the superabrasive lap surface plate.

BACKGROUND INFORMATION

First, a grindstone prepared by bonding superabrasive grains of diamond or CBN with a metal, resin or a vitrified bond is known as a superabrasive grindstone which is a kind of superabrasive tool. Further, a grindstone prepared by holding and fixing superabrasive grains on a base by electroplating is known as a superabrasive grindstone in the form of holding superabrasive grains in a single layer. Such a superabrasive grindstone is called an electroplated superabrasive grindstone. The grains are generally fixed onto the base to such a degree that the superabrasive grains come into contact with each other, and hence the degree of concentration of grains may be too high, depending on the purpose of grinding performed with this grindstone. As a countermeasure therefor, means are employed for improving the flow of a grinding fluid and eliminating chips, such as a method of locally inhibiting electroplating by a method of (1) providing grinding grooves on the grinding surface of the grindstone or (2) locally applying an insulating paint to the base, and locally forming a part having no superabrasive grains on the grinding surface.

On the other hand, the thickness of a plating layer is rendered at least ½ the diameter of the superabrasive grains, in order to ensure holding power for the superabrasive grains.

With respect to the aforementioned electroplated superabrasive grindstone, a superabrasive grindstone in which superabrasive grains are fixed onto a base by a brazing filler metal layer is known. As to diamond abrasive grains, for example, the so-called brazing method utilizing such a characteristic that an alloy consisting of nickel, cobalt and chromium or an alloy consisting of silver, copper and titanium readily wets surfaces of diamond abrasive grains and directly fixing diamond abrasive grains onto a base by employing this alloy is also known.

Further, a porous resin bond grindstone employing fine diamond grains is proposed as a grindstone for attaining working of high accuracy and a high grade. Increase of chip pockets or the like is aimed to be achieved by a porous part in this grindstone.

Surface roughness of a ground surface is regarded as being decided by the effective abrasive grain number per unit surface area of the grindstone. However, how to grasp the effective abrasive grain number with respect to the grain sizes and the degree of concentration of the abrasive grains is not necessarily clear, and there has been the following problem depending on the levels of the grain sizes of the abrasive grains.

In a grindstone employing abrasive grains having relatively large grain sizes, i.e., coarse grains, holding power for the abrasive grains is strong, fewer abrasive grains are dropped out of the grindstone and the flow of a grinding fluid is also excellent. However, the accuracy of a surface ground by coarse grains is low and its surface roughness is large. In a grindstone employing abrasive grains having relatively small grain sizes, i.e., fine grains, on the other hand, it is possible to increase the accuracy of a ground surface and to reduce its surface roughness. However, holding power for small abrasive grains is weak, more abrasive grains are dropped, and the flow of the grinding fluid is also inferior. In the grindstone employing fine grains, therefore, grinding performance is low, the abrasive grains become ungrindable following slight wear, and the life of the grindstone is short.

To prepare a diamond rotary dresser, i.e. a kind of superabrasive tool, it is well known to fix diamond abrasive grains to the outer peripheral surface of a cylindrical base in a single layer, as disclosed in Japanese Patent Laying-Open No. 59-47162, for example.

Another example of a known diamond rotary dresser is disclosed in Japanese Patent Publication No. 1-22115. These diamond rotary dressers, having wide acting ranges, are employed for dressing a conventional grindstone of WA or GC (type of JIS) or a CBN grindstone with high accuracy. Means for densely fixing diamond grains onto a base, flattening surfaces acting on dressing by truing forward end portions of the diamond grains and improving dressing accuracy are various means employed by the diamond rotary dresser.

However, the formation of flat surfaces on the forward end portions of the diamond grains lowers the sharpness of the diamond rotary dresser. Thus, the dressing resistance increases when a conventional grindstone of WA or GC or a CBN grindstone is dressed. Consequently, there has been such a problem that vibration takes place in dressing and the vibration exerts a bad influence on shaping accuracy of the grindstone, i.e., transfer accuracy to the grindstone.

Further, a superabrasive lap surface plate is a kind of superabrasive tool. Recently, improvements in the accuracy of flatness and parallelism of a workpiece is required in lapping, due to rapid technological innovation such as high integration in a semiconductor device or superprecision in metal working or ceramics working. This results in demands of greater accuracy not only of the lapping machine employed for this working, but also intensifies the requirement of accuracy and characteristics for the lap surface plate.

Lapping refers to a method of working a surface by supplying free abrasive grains mixed into a lap liquid between a lap surface plate and a workpiece, rubbing the lap surface plate and the workpiece with each other while applying pressure, scraping the workpiece by rolling action and scratch action of the free abrasive grains and obtaining a high accuracy surface.

The lap surface plate employed for conventional lapping is made of cast iron. For example, a lap surface plate of spherical graphite cast iron is generally employed for lapping on a silicon wafer. The lap surface plate must have such properties that ensure that it is capable of maintaining accuracy of a flat surface over a long period, that the material is homogeneous without irregularity in hardness, without casting defects that will cause scratching on the surface of the workpiece, and with a holding ability for abrasive grains. In order to satisfy the above necessary conditions, cast iron is generally employed as the material for the lap surface plate.

In conventional lapping, however, a great many free abrasive grains are consumed, and hence, great volumes of mixtures of used free abrasive grains, chips and a lap liquid, i.e., sludge are generated. As a result deterioration of working environment and occurrence of environmental pollution have become a significant subject of discussion.

OBJECTS OF THE INVENTION

Accordingly, it is an object of the present invention to provide a superabrasive grindstone capable of improving accuracy of a ground surface, in which the holding power for superabrasive grains is large, chipping or dropping of superabrasive grains is small and flow of a grinding fluid is also excellent, and a method of manufacturing the same.

Another object of the present invention is to provide a super-abrasive dresser which can reduce dressing resistance and is thereby capable of preventing vibration occurrence in dressing and improving dressing accuracy, and a method of manufacturing the same.

Further, still another object of the present invention is to provide a superabrasive lap surface plate which can reduce the generation of sludge and is capable of performing lapping of high accuracy and high efficiency, and a method of manufacturing the same.

Briefly stated, the object of the present invention is to provide a superabrasive tool such as a superabrasive grindstone, a superabrasive dresser or a superabrasive lap surface plate capable of improving working accuracy and a method of manufacturing the same.

SUMMARY OF THE INVENTION

A superabrasive tool according to the present invention comprises a base and a superabrasive layer formed on the base. The superabrasive layer includes superabrasive grains and a holding layer holding and fixing the superabrasive grains onto the base. Concave parts are formed on surfaces of the superabrasive grains exposed from the holding layer.

The concave parts include all forms of depressions from the superabrasive grain surfaces, such as holes.

According to a preferred embodiment of the superabrasive tool of the present invention, concave parts or depressions are formed also on a surface of the holding layer. More preferably, the concave parts formed on the surfaces of the superabrasive grains and the concave parts formed on the surface of the holding layer are continuously formed.

According to another preferred embodiment of the present invention, the concave parts are formed on the surfaces of the superabrasive grains projecting from the holding layer. More preferably, the projecting surfaces of the superabrasive grains have flat surfaces, and the concave parts are formed on the flat surfaces.

According to still another embodiment of the superabrasive tool of the present invention, the surfaces of the exposed superabrasive grains have flat surfaces, and the flat surfaces form a substantially parallel plane with the surface of the holding layer. However, the flat surfaces of the superabrasive grains preferably project from the surface of the holding layer by at least 10 $\mu$m. Therefore, it is assumed that the "substantially parallel plane" includes deviation of the surface height of about 10 $\mu$m. Also in case of this embodiment, it is preferable that concave parts are formed on the surface of the holding layer. More preferably, the concave parts formed on the surfaces of the superabrasive grains and the concave parts formed on the surface of the holding layer are continuously formed.

In the superabrasive tool according to the present invention, the holding layer preferably includes a plating layer, or includes a brazing filler metal layer.

A superabrasive grindstone, a superabrasive dresser, a superabrasive lap surface plate or the like can be cited as the superabrasive tool to which the present invention is directed.

The method of manufacturing a superabrasive tool according to the present invention comprises a step of forming a holding layer holding and fixing superabrasive grains on a base so that surfaces thereof are partially exposed, and a step of forming concave parts by irradiating with a laser beam the surfaces of the superabrasive grains exposed from the holding layer.

Preferably, the method of manufacturing a superabrasive tool according to the present invention further comprises a step of forming concave parts by irradiating a surface of the holding layer with a laser beam. More preferably, the steps of forming the concave parts on the surfaces of the superabrasive grains and the surface of the holding layer include an operation of continuously forming the concave parts on the surfaces of the superabrasive grains exposed from the holding layer and the surface of the holding layer by continuously irradiating the same with the laser beam.

According to another embodiment of the method of manufacturing a superabrasive tool of the present invention, the step of forming the concave parts includes an operation of forming the concave parts by irradiating the surfaces of the superabrasive grains projecting from the holding layer with the laser beam.

According to still another embodiment of the method of manufacturing a superabrasive tool of the present invention, the method further comprises a step of substantially uniformly flattening the surfaces of the superabrasive grains exposed from the holding layer, and the step of forming the concave parts by irradiating the surfaces with the laser beam includes an operation of flattening the surfaces of the superabrasive grains and thereafter irradiating the surfaces with the laser beam. In this case, the step of flattening the surfaces of the superabrasive grains preferably includes an operation of flattening the surfaces of the superabrasive grains so that the surfaces of the exposed superabrasive grains form a substantially continuous plane that is coplanar with the surface of the holding layer. More preferably, the method of manufacturing a superabrasive tool according to the present invention further comprises a step of forming concave parts by irradiating the surface of the holding layer with a laser beam, and the steps of forming the concave parts on the surfaces of the superabrasive grains and the surface of the holding layer include an operation of continuously forming the concave parts on the flattened surfaces of the superabrasive grains and the surface of the holding layer by continuously irradiating the same with the laser beam.

Preferably, the step of forming the holding layer in the method of manufacturing a superabrasive tool according to the present invention includes an operation of forming a plating layer or an operation of forming a brazing filler metal layer.

The step of forming the holding layer including the plating layer preferably includes the following steps:

(i) a step of sticking the superabrasive grains to a surface of a mold with a conductive adhesive layer.

(ii) a step of dipping the mold to which the superabrasive grains are stuck in a plating solution of a first metal for forming a plating layer of the first metal partially covering the surfaces of the superabrasive grains in a thickness less than ½ the mean grain size of the superabrasive grains.

(iii) a step of forming a plating layer of a second metal which is different from the first metal on the plating layer of the first metal in a thickness completely covering the superabrasive grains.

(iv) a step of fixing the plating layer of the second metal to the base by a bond layer.

(v) a step of removing the mold from the superabrasive grains.

(vi) a step of removing the plating layer of the first metal by etching and partially uniformly exposing the surfaces of the superabrasive grains.

In the superabrasive tool according to the present invention comprising the aforementioned characteristics, the following actions/effects can be attained in response to the types of the tool:

First, in a superabrasive grindstone, sharpness and working accuracy become excellent, accuracy of a ground surface improves and surface roughness of the ground surface can be reduced, while holding power for the abrasive grains can be improved. At the same time, chipping or dropping of the abrasive grains can be reduced, and flow of a grinding fluid can also be made excellent.

In a superabrasive dresser, dressing resistance can be reduced, sharpness and accuracy improve while occurrence of vibration in dressing can be prevented, and dressing accuracy can be improved. Particularly in the superabrasive dresser, a superabrasive dresser improving dressing accuracy in response to the shape of a grindstone can be structured by forming concave parts only on the surfaces of the superabrasive grains dressing a shoulder portion or an end portion of the grindstone, or by forming concave parts on the surfaces of the superabrasive grains in correspondence to only a part to which shaping accuracy is required in a workpiece.

In a superabrasive lap surface plate, working is performed with fixed abrasive grains in place of conventional working with free abrasive grains, thereby reducing the generation of sludge. This makes it possible to maintain a plane of higher accuracy, and lapping of high efficiency can be performed.

Concretely, the first characteristic of the superabrasive grindstone according to the present invention is based on an absolutely new idea, which has both of the respective advantages of a conventional grindstone employing fine grains and a grindstone employing coarse grains and is capable of increasing the effective abrasive grain number without increasing the concentration of the abrasive grains. As a method of implementing it, the present invention divides the projecting portions of the superabrasive grains in an abrasive layer by concave parts or grooves, and thereby provides a plurality of abrasive grain end surfaces. According to this method, the effective abrasive grain number can be increased analogous to an abrasive surface of fine grains having a high degree of concentration by: employing coarse grains of large superabrasive grains with a relatively low degree of concentration; working the projecting parts from a bond serving as the holding layer therefor into flat surfaces, providing grooves on the flat surfaces, thereby dividing the abrasive surface of the superabrasive grains and forming a plurality of abrasive end surfaces. When the employed superabrasive grains are in the form of prisms and flat surfaces exist on the projecting parts from the start, or the heights of the projecting parts are extremely uniformly regular, flattening such as truing can be omitted. Further, the grooves are preferably intersectionally provided to be formed just as lines defining clearances on a go board or checkerboard.

It is also possible to form a sharp insert part by forming grooves on the projecting surfaces of the superabrasive grains without working the projecting parts of the superabrasive grains from the bond serving as the holding layer into flat surfaces. It is not necessary to form the grooves on the projecting surfaces of all superabrasive grains, and superabrasive grains with no grooves may exist. The grooves may be formed on the projecting parts of the superabrasive grains partially subjected to flattening such as truing.

When employing superabrasive grains of relatively large grain sizes, it is preferable to employ grains that are substantially regular in size. An excellent effect can be attained by employing superabrasive grains having grain sizes of at least 50 $\mu$m, more preferably superabrasive grains having grain sizes within the range of #20 to #40.

When a plating layer is employed as the holding layer holding the superabrasive grains, it is possible to omit the operation of working the projecting surfaces of the superabrasive grains of a grindstone to be flat by substantially uniformly regularizing the amounts of projection of the superabrasive grains when producing the grindstone. Also, as to the grooves formed on the flattened projecting surfaces of the superabrasive grains, the depths and the widths thereof, the angle at which the plurality of grooves intersect in the form of lines defining clearances on a go board or a checkerboard, and the like can be selected by adjusting the irradiation method of the laser beam. Thus, it is possible to improve the sharpness of the grindstone and elimination of chips, thereby improving the grinding accuracy.

As to the bond employed as the holding layer holding the superabrasive grains, resin can also be employed in addition to metal or a vitrified bond. The superabrasive layer is formed in a single layer, and hence it is preferable to employ a metal having high bonding strength as the material for the bond. The metal is preferably formed by electroplating or brazing.

In case of flatly working the projecting surfaces of the superabrasive grains, the superabrasive grains are held on the base with the aforementioned bond, thereafter the flat surfaces are formed while substantially uniformly regularizing the heights of the projecting ends of the superabrasive grains by truing, and the flat surfaces of the respective abrasive grains are irradiated with a laser beam for forming the grooves.

As hereinabove described, the abrasive surface is formed by superabrasive grains whose grain sizes are relatively large. Hence the surface roughness of a worked surface is essentially relatively large if ground with the grindstone comprising the abrasive surface of such superabrasive grains. In the present invention, however, grooves are formed by irradiating the flat surfaces or the projecting surfaces of the superabrasive grains with the laser beam. By substantially regularizing the projecting heights of the superabrasive grains and/or forming flat surfaces on the forward end portions of the abrasive grains, the grooves form a number of abrasive end surfaces on the flat surfaces or the projecting surfaces. These abrasive end surfaces act as an insert or a flat drag and increase the effective abrasive grain number. The accuracy of the worked surface is improved and its surface roughness reduced by employing the superabrasive grindstone thus structured.

Because the grain sizes of the superabrasive grains forming the abrasive surface are large, a strong abrasive surface can be stably formed by fixing the superabrasive grains to the base by the aforementioned electroplating, or by fixing the superabrasive grains to the base by an operation of melting an alloy mainly composed of nickel-cobalt-chromium or an alloy mainly composed of silver-titanium-copper, i.e., by brazing. Fixing the superabrasive grains to the base by brazing provides greater holding power for holding the superabrasive grains than fixing the superabrasive grains to the base by electroplating, such as nickel plating. Therefore, the amounts of projection of the superabrasive grains can be increased in case of fixing the superabrasive grains by a brazing method. Consequently, the so-called chip pockets can be enlarged according to the brazing method. While it is necessary to hold at least 50% of the superabrasive grain when using nickel plating as a holding layer for the superabrasive grains, for example, the brazing method provides sufficient holding power when merely 20 to 30% of the grain is held by a brazing filler metal layer.

Further, a space on a surface part of the superabrasive layer formed by the projecting parts of the large-size superabrasive grains and the surface of the holding layer is enlarged by the grooves formed on the projecting parts. The grooves divide the insert and reduce the size of the grinding chip. As a result, the flow of the grinding fluid and elimination of the chips even out, and the sharpness improves.

While it has been described that the effective abrasive grain number and the space on the surface part of the superabrasive layer can be increased by forming grooves on the surfaces of the superabrasive grains projecting from the surface of the holding layer as the above, the effective abrasive grain number can also be increased in such a grindstone on which the exposed surfaces of the superabrasive grains and the surface of the holding layer are flattened substantially on the same planes, by selecting the depth and the width of the grooves, the angle of intersection in the form of lines defining clearances on a go board or checkerboard formed by the plurality of grooves and the like by adjusting the irradiation method of the laser beam. In this case, the effective abrasive grain number can be increased by forming grooves on the exposed surfaces of the superabrasive grains and the surface of the holding layer when recycling a grindstone, the abrasive surface of which flattens with use, and the grindstone can be recycled so that prescribed grinding performance is attained. Further, the grindstone structured as described above can perform dressing when in use or every time the same is used, as needed.

As hereinabove described, relatively large superabrasive grains of coarse grains can be employed in the superabrasive grindstone according to the present invention, whereby the absolute value of an embed depth in the holding layer is deeper than a grindstone employing superabrasive grains of fine grains. Therefore, the degree of bonding by the holding layer is strong, and chipping or dropping of the superabrasive grains by grinding is less.

The grooves are provided on the projecting surfaces or the flattened exposed surfaces of the superabrasive grains and a number of substantially uniformly regularized abrasive end surfaces are formed, as if superabrasive grains of fine grains were employed. The effective number of abrasive grains increases with respect to the grain sizes, the degree of concentration of the superabrasive grains. Therefore, it is possible to improve the sharpness of the grindstone and the accuracy of the ground surface. By regularizing the grain sizes of the employed superabrasive grains and further regularizing the projecting heights of the superabrasive grains from the surface of the holding layer, the effective abrasive grain number thereby increases. The effective abrasive grain number can be increased by irradiating the projecting surfaces of the superabrasive grains with the laser beam to form grooves in the surfaces. Further, it is possible to provide a superabrasive grindstone with excellent sharpness and grinding accuracy by irradiating the projecting surfaces or the flattened exposed surfaces with the laser beam to form regular or irregular grooves similar to lines defining clearances on a go board or checkerboard and selecting the number of the grooves, the intervals between the grooves, the angle at which the grooves intersect and the like. Therefore, the grindstone of the present invention can facilitate a changeover to working with fixed abrasive grains from working with free abrasive grains, which has generally been done in high-grade working of electronic, optical components or the like, for example.

In the superabrasive dresser according to the present invention, grooves are formed on diamond abrasive grains fixed to a diamond rotary dresser, for example. Namely, grooves are formed on the abrasive surface of the diamond grains by irradiating with a laser beam exposed surfaces of the diamond grains projecting from a surface of a holding layer of the diamond rotary dresser or by irradiating exposed surfaces of the diamond grains substantially on the same plane as the surface of the holding layer. This effectively divides the abrasive surfaces of the diamond grains. Thus, a resistance value in dressing is reduced which prevents the occurrence of vibration in dressing. Moreover, the dressing operation can be performed with high efficiency by further improving dressing accuracy.

The inventors have carried out further repeated trial manufacturing and studies as to the aforementioned diamond rotary dresser, and have discovered that it is not necessary to perform the operation of forming the grooves on the exposed surfaces of the diamond grains and dividing projecting end surfaces or flattened exposed end surfaces of the diamond grains over the entire surface where the dresser acts. In dressing a grindstone having a shoulder portion or the like, for example, grooves are formed only on the surface part that effectively dresses the shoulder portion of the grindstone which is a portion that readily causes burning in an operating surface of the dresser. Or, as to dressing a portion of the grindstone to which accuracy is particularly required, the truing amount of the diamond layer is large and sharpness decreases due to the fact that the flat part areas of the diamond grains increase, and hence grooves are formed only on this portion. It is most effective in manufacturing and use of the dresser to form the grooves on only such a necessary portion.

Also in the dresser according to the present invention, relatively large superabrasive grains of coarse grains can be employed similarly to the grindstone, whereby bonding strength by the holding layer is strong, and chipping and dropping of the superabrasive grains by grinding are less. Also in the dresser of the present invention, the effective abrasive grain number is increased with respect to the grain sizes, the degree of concentration of the employed abrasive grains. A dresser that further improves sharpness and accuracy can be provided by selecting the number of the grooves, the intervals between the grooves, the angle at which the grooves intersect and the like. No end surface burning is caused in dressing and the resistance value in dressing and occurrence of vibration can also be reduced by forming the grooves only on the part for dressing the shoulder portion of the grindstone or a part to which accuracy is required in particular.

The superabrasive lap surface plate according to the present invention solves the conventional problems by changing from working with free abrasive grains to working with fixed abrasive grains. This reduces the generation of sludge greatly and enables operation in a clean environment. It is also possible to continue to maintain a high-accuracy plane of the lap surface plate over a long period. Efficiency in a lapping operation is also improved by working with fixed abrasive grains. To this end, grooves are formed on diamond grains fixed to a diamond lap surface plate of the present invention. Namely, the grooves are formed by irradiating with a laser beam exposed surfaces of diamond grains fixed to project from a surface of a bond layer that is a holding layer of the diamond lap surface plate, or by irradiating surfaces of diamond grains fixed to be exposed substantially on the same plane as the surface plane of the holding layer, for dividing abrasive surfaces of the diamond grains.

In the superabrasive tool according to the present invention, further, at least one or two holes are formed by irradiating the exposed surfaces of the superabrasive grains with a laser beam, in place of forming the grooves by irradiating the exposed surfaces of the superabrasive grains with the laser beam and dividing the abrasive surfaces of the superabrasive grains. It is preferable that the diameter and the depth of this hole are at least 20 $\mu$m, and more preferably the diameter of the hole is at least 50 $\mu$m and the depth of the hole is at least 30 $\mu$m. Further, it is more preferable that the holes are formed on an exposed surface of the holding layer holding the superabrasive grains and the boundary between the exposed surfaces of the superabrasive grains and the exposed surface of the holding layer.

In the aforementioned structure, the effective abrasive grain number can be increased analogous to an abrasive surface employing superabrasive grains of fine grains in a high degree of concentration, by employing superabrasive grains of coarse grains whose degree of concentration is relatively low. This is accomplished by working the exposed surfaces or the surfaces projecting from the holding layer into flat surfaces and forming at least one or two holes on the flat surfaces so that peripheral edge portions of the holes act as an insert. When the employed superabrasive grains are in the form of prisms and the projecting surfaces are flat surfaces from the start, or when the heights of the exposed surfaces of the superabrasive grains are extremely uniformly regular, a flattening step such as truing may be omitted. The holes may be formed on the exposed surfaces without flattening the exposed surfaces of the superabrasive grains, as a matter of course.

It is necessary that the diameter of the holes formed on the exposed surfaces of the superabrasive grains is at least 50 $\mu$m and the depth is at least 30 $\mu$m, in order to make the peripheral edge portions of the holes act as an insert, and in consideration of elimination of chips. As to the relatively large superabrasive grains, it is preferable to employ those grain sizes that are substantially uniformly regular. Further, the grain sizes of the superabrasive grains are preferably at least 50 $\mu$m, and an excellent action/effect can be attained when selecting the grain sizes within the range of #20 to #40.

Further, a superabrasive tool which provides excellent sharpness and superior elimination of chips is achieved, due to the fact that the holes are formed not only on the exposed parts of the superabrasive grains but also on the exposed part of the holding layer and on the boundary between the exposed parts of the superabrasive grains and the exposed part of the holding layer. It is effective that the holes are formed on the overall exposed part of the superabrasive layer including the holding layer, and that the open areas of the holes preferably constitute at least 20% with respect to the overall surface area of the exposed part of the superabrasive layer.

According to the superabrasive tool with holes formed on the exposed surfaces of the superabrasive grains, the peripheral edge portions of the holes act as an insert or a flat drag, and an effect similar to that of increasing the effective abrasive grain number is attained. Therefore, accuracy of the worked surface is improved. Further, the holes are isolated from each other and it is estimated that there is no danger of the tool breaking during grinding because of a pressing force due to the presence of these holes.

DETAILED DESCRIPTION OF PREFERRED EXAMPLE EMBODIMENTS AND OF THE BEST MODE OF THE INVENTION

First, the types of superabrasive tools to which the present invention is applied are described.

Figure 1:
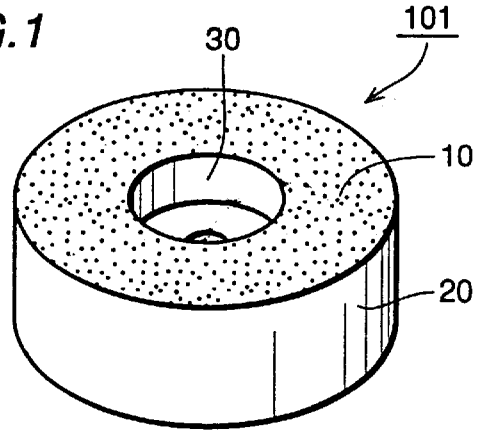
FIG. 1 is a perspective view showing a cup-type grindstone to which the present invention is applied.
Figure 2:
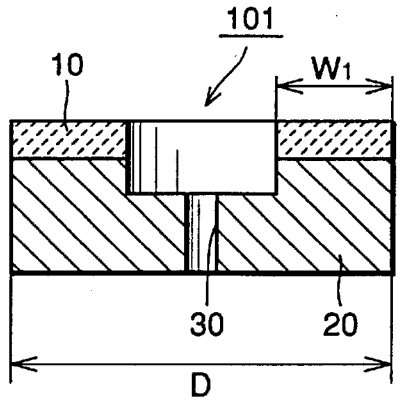
FIG. 2 is a sectional view showing the cup-type grindstone to which the present invention is applied.

As shown in FIG. 1, a superabrasive layer 10 is formed on one end surface of a base 20 having a cylindrical shape in a cup-type superabrasive grindstone 101. The cup-type superabrasive grindstone 101 has a mounting shaft hole 30. A surface of the rotating superabrasive layer 10 of the cup-type superabrasive grindstone 101 comes into contact with a workpiece and grinding is performed by rotation about this mounting shaft hole 30. As shown in FIG. 2, the cup-type superabrasive grindstone 101 has a diameter D, and has a width $W_1$ of the abrasive surface.

Figure 3:
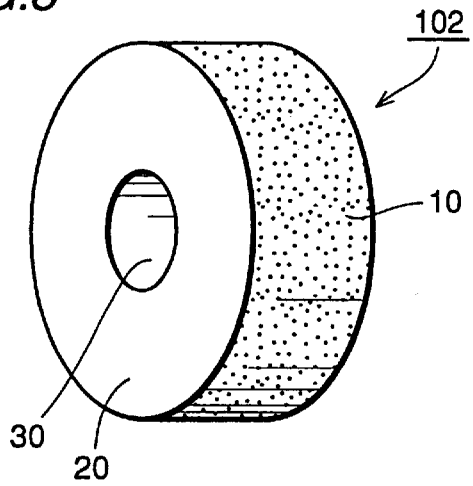
FIG. 3 is a perspective view showing a straight-type grindstone to which the present invention is applied.
Figure 4:
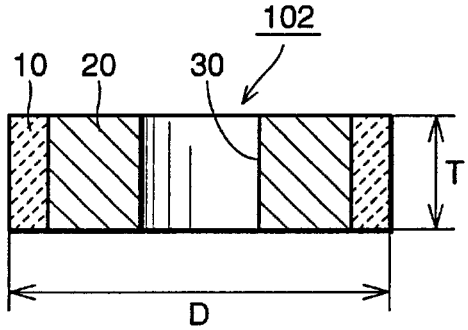
FIG. 4 is a sectional view showing the straight-type grindstone to which the present invention is applied.

As shown in FIG. 3, a superabrasive layer 10 is formed on an outer peripheral surface of a cylindrical base 20 in a straight-type superabrasive grindstone 102. An abrasive surface of the rotating superabrasive layer 10 comes into contact with a workpiece by rotating the straight-type superabrasive grindstone 102 about a mounting shaft hole 30 whereby grinding is performed. As shown in FIG. 4, the straight-type superabrasive grindstone 102 has a diameter D and a thickness T.

Figure 5:
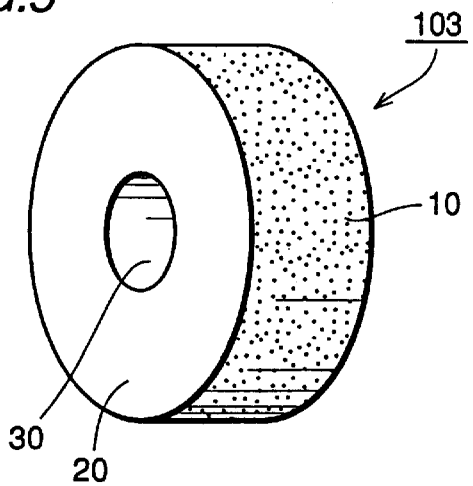
FIG. 5 is a perspective view showing a rotary dresser to which the present invention is applied.
Figure 6:
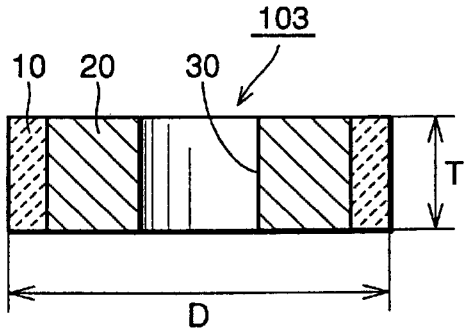
FIG. 6 is a sectional view showing the rotary dresser to which the present invention is applied.

As shown in FIG. 5, a superabrasive layer 10 is formed on an outer peripheral surface of a base 20 in a superabrasive dresser, e.g., a diamond rotary dresser 103. A surface of the superabrasive layer 10 comes into contact with a surface of a grindstone by rotating the superabrasive dresser 103 about a mounting shaft hole 30 whereby dressing of the grindstone is performed. As shown in FIG. 6, the superabrasive dresser 103 has a diameter D and a thickness T.

Figure 7:
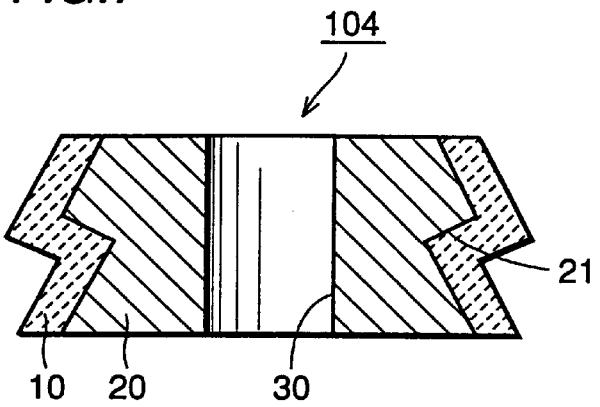
FIG. 7 is a sectional view showing a rotary dresser comprising a shoulder portion to which the present invention is applied.

As shown in FIG. 7, a superabrasive layer 10 is formed on an outer peripheral surface of a base 20 in a superabrasive dresser 104. The base 20 has a shoulder portion 21, and the superabrasive layer 10 is formed also on this shoulder portion 21. As described later, grooves are preferably formed only on the superabrasive layer 10 positioned on the shoulder portion 21 in accordance with the present invention.

Figure 8:
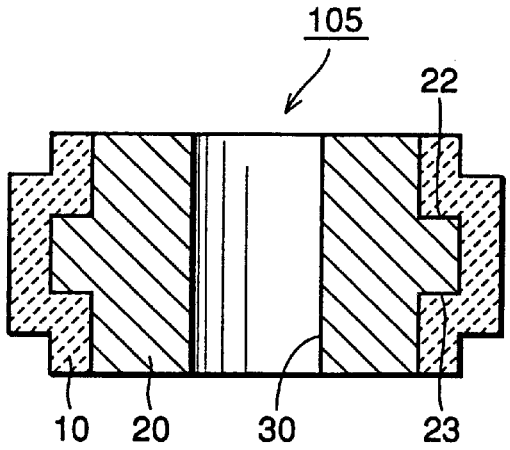
FIG. 8 is a sectional view showing a rotary dresser comprising an end surface to which the present invention is applied.

As shown in FIG. 8, further, a superabrasive layer 10 is formed on an outer peripheral surface of a base 20 in a superabrasive dresser 105. The base 20 has end surfaces 22 and 23 which are opposed to each other. The superabrasive layer 10 is formed also on these end surfaces 22 and 23. Grooves according to the present invention are preferably formed only on the superabrasive layer positioned on the end surfaces 22 and 23.

Also in the superabrasive dressers 104 and 105 shown in FIG. 7 and FIG. 8, surfaces of the rotating superabrasive layers 10 come into contact with abrasive surfaces of grindstones by rotation about mounting shaft holes 30 so that dressing of the grindstones is performed.

Figure 9:
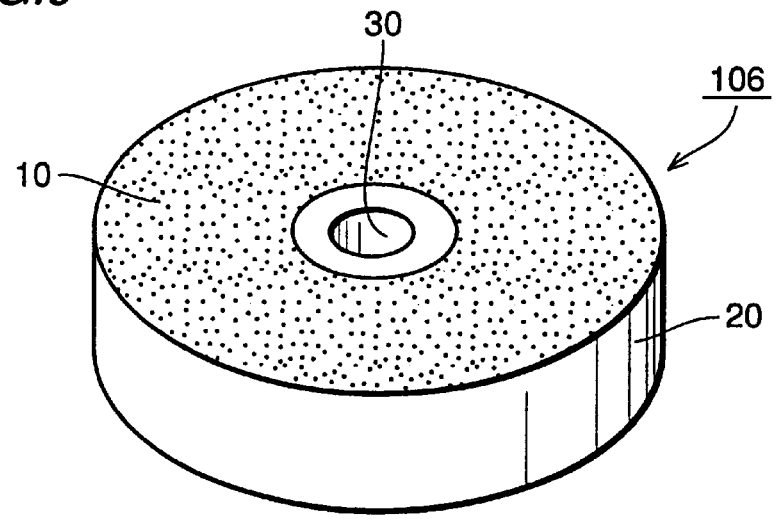
FIG. 9 is a perspective view showing a lap surface plate to which the present invention is applied.
Figure 10:
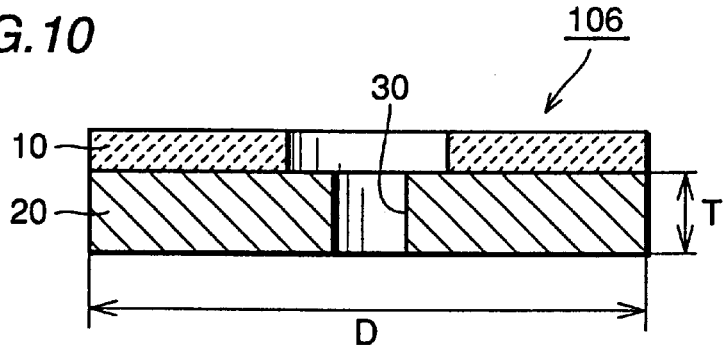
FIG. 10 is a sectional showing the lap surface plate to which the present invention is applied.

As shown in FIG. 9, a superabrasive layer 10 is fixed onto one end surface of a base 20 in a superabrasive lap surface plate according to the present invention, e.g., a diamond lap surface plate 106. Lapping is performed by rubbing a workpiece against a surface of the rotating superabrasive layer 10 while applying pressure by rotating the superabrasive lap surface plate 106 about a mounting shaft hole 30. The superabrasive lap surface plate 106 has a diameter D and a thickness T as shown in FIG. 10.

In every aforementioned superabrasive tool, abrasive grains of diamond, cubic boron nitride (CBN) or the like are employed as superabrasive grains forming the superabrasive layer 10. A material made of a metal is employed as the base 20, and cast iron or the like is employed for the base 20 of the superabrasive lap surface plate 106 in particular.

Methods of forming concave parts or concavities such as grooves or holes on surfaces of the superabrasive layers of the aforementioned various types of superabrasive tools are now described.

Figure 11:
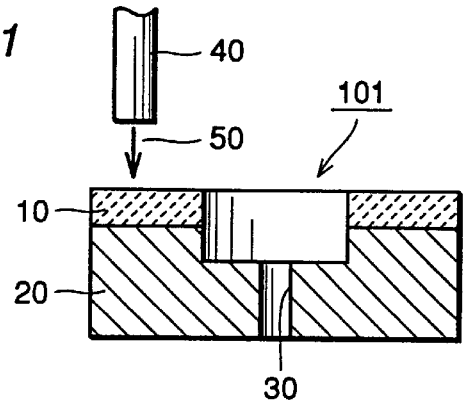
FIG. 11 is a model diagram showing laser beam machining in case of irradiating an abrasive surface of the cup-type grindstone to which the present invention is applied with a laser beam in a normal direction.
Figure 12:
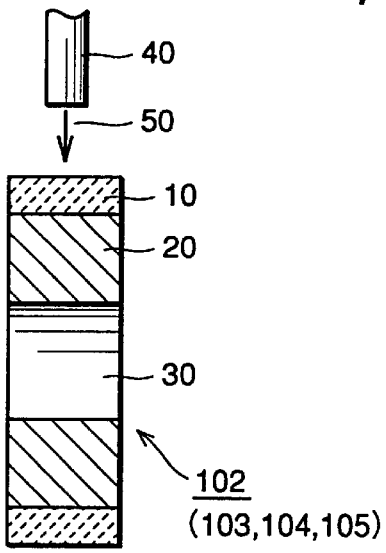
FIG. 12 is a model diagram showing laser beam machining in case of irradiating an operating surface or an abrasive surface of the straight-type grindstone or the rotary dresser to which the present invention is applied with a laser beam in a normal direction.
Figure 13:
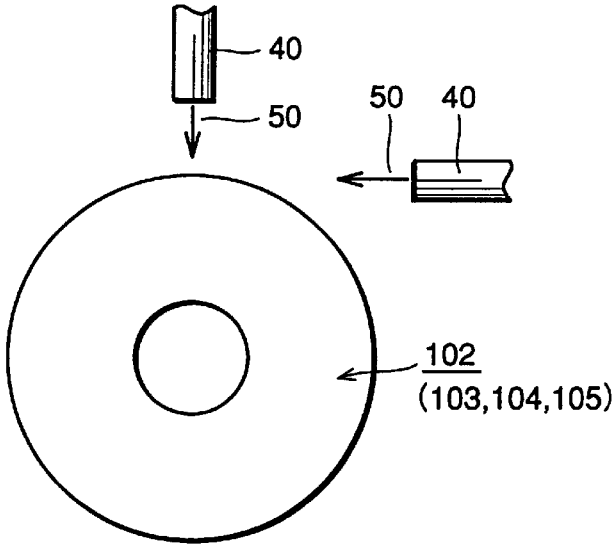
FIG. 13 is a model diagram showing laser beam machining in case of irradiating the abrasive surface of the straight-type grindstone or the rotary dresser to which the present invention is applied with laser beams in a tangential direction and a normal direction.

As shown in FIG. 11, concavities such as grooves or holes are formed on a surface of the superabrasive layer 10, i.e., exposed surface(s) of the superabrasive grains or a holding layer, by irradiating the surface of the superabrasive layer of the cup-type superabrasive grindstone 101 with a laser beam 50 from a laser beam machining unit 40 in a normal direction. When forming grooves or holes on a surface of the superabrasive layer 10 of the straight-type superabrasive grindstone 102 or the superabrasive dresser 103, 104 or 105, the surface of the superabrasive layer 10 is irradiated with a laser beam 50 from a laser beam machining unit 40 from the normal direction, as shown in FIG. 12 or 13. When forming the grooves, the superabrasive layer 10 of the straight-type superabrasive grindstone 102 or the superabrasive dresser 103, 104 or 105 may be irradiated with the laser beam 50 from a tangential direction, as shown in FIG. 13. When forming grooves or holes on the surface of the superabrasive layer 10 of the superabrasive lap surface plate 106, the surface of the superabrasive layer 10 is irradiated with a laser beam 50 from a normal direction.

Various forms of the grooves or holes formed by irradiating the surface of the superabrasive layer 10 with the laser beam as described above are described.

Forms of grooves or holes in such cases when exposed parts of superabrasive grains 11 project as shown in FIG. 15 to FIG. 22 will now be described. In FIG. 15, FIG. 17, FIG. 19 and FIG. 21, the superabrasive layers 10 comprise superabrasive grains 11, nickel plating layers 16 holding the superabrasive grains 11, and bond layers 17 bonding the nickel plating layers 16 to the bases 20. As shown in FIG. 16, FIG. 18, FIG. 20 and FIG. 22, on the other hand, the superabrasive grains 11 are held by brazing filler metal layers 18, and directly fixed to the bases 20.

Figure 15:
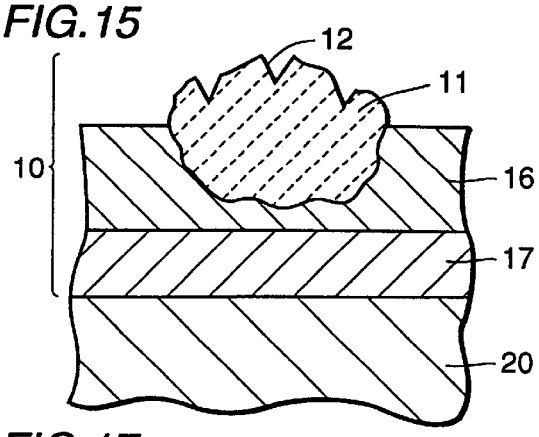
FIG. 15 to FIG. 22 are partial sectional views showing various of grooves or holes formed on exposed parts of superabrasive grains that project from holding layers in accordance with the present invention.
Figure 16:
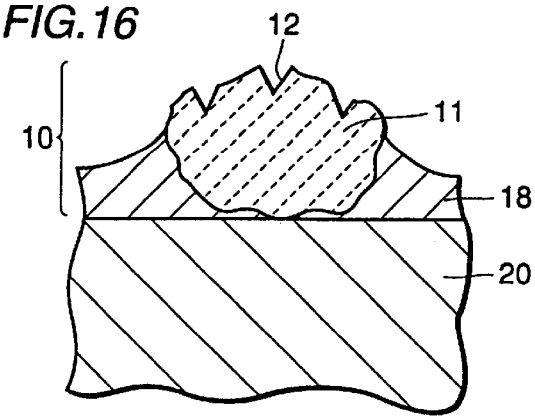
Figure 17:
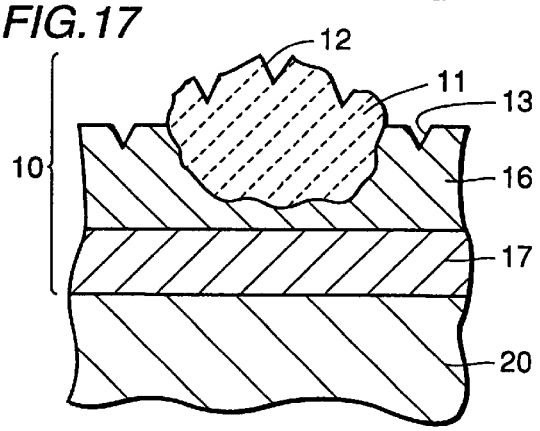
Figure 18:
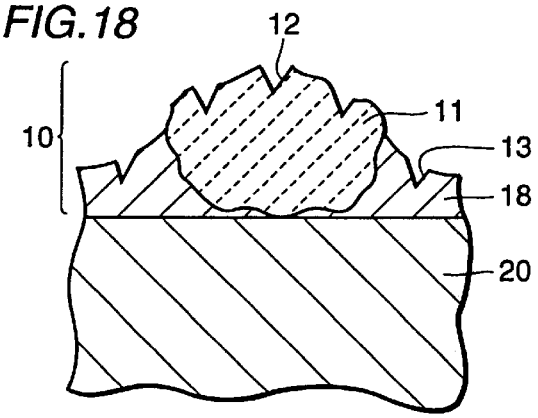
Figure 19:
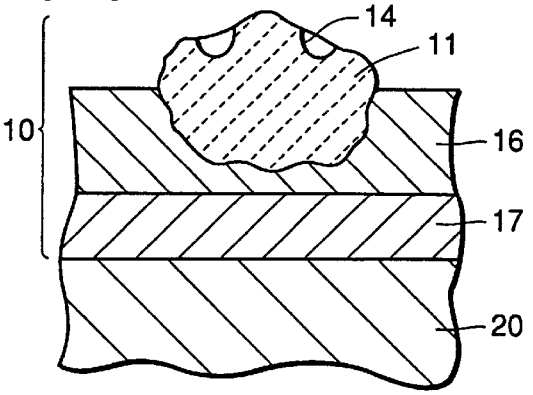
Figure 20:
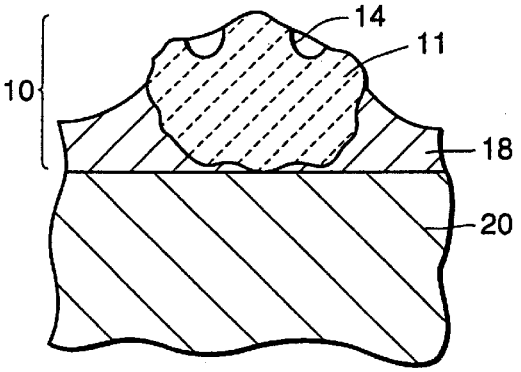
Figure 21:
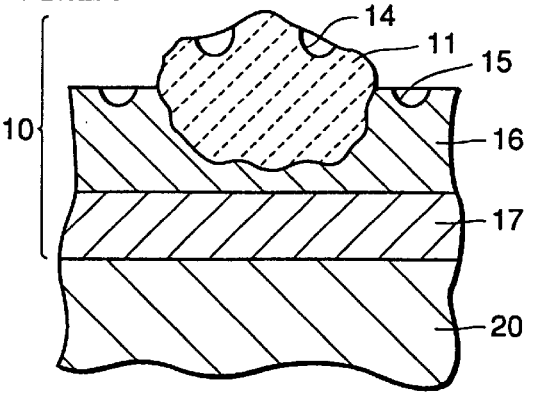
Figure 22:
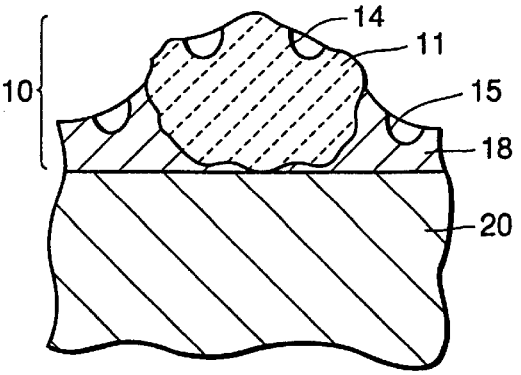

As shown in FIG. 15 and FIG. 16, the exposed parts of the superabrasive grains 11 are not flattened, but in irregular states. Plural grooves 12 are formed on the exposed surfaces of the superabrasive grains 11. As shown in FIG. 17 and FIG. 18, grooves 12 are formed on surfaces of unflattened superabrasive grains 11, and grooves 13 are formed on a surface of the nickel plating layer 16 or the brazing filler metal layer 18 serving as the holding layer. In embodiments shown in FIG. 19 and FIG. 20, holes 14 are formed on unflattened exposed surfaces of the superabrasive grains 11. In embodiments shown in FIG. 21 and FIG. 22, holes 14 are formed on exposed surfaces of unflattened superabrasive grains 11, and holes 15 are formed on the surface of the nickel plating layer 16 or the brazing filler metal layer 18 serving as the holding layer.

Various forms of grooves or holes in such cases when exposed parts of superabrasive grains 11 comprise flat surfaces 19 as shown in FIG. 23 to FIG. 30 will now be described. In embodiments of FIG. 23, FIG. 25, FIG. 27 and FIG. 29, the superabrasive layers 10 comprise the superabrasive grains 11, nickel plating layers 16 holding the superabrasive grains 11, and bond layers 17 for bonding the nickel plating layers 16 to the bases 20. In embodiments shown in FIG. 24, FIG. 26, FIG. 28 and FIG. 30, on the other hand, the superabrasive layers 10 comprise the superabrasive grains 11 and brazing filler metal layers 18 holding the superabrasive grains 11 and directly fixing the same to the bases 20.

Figure 23:
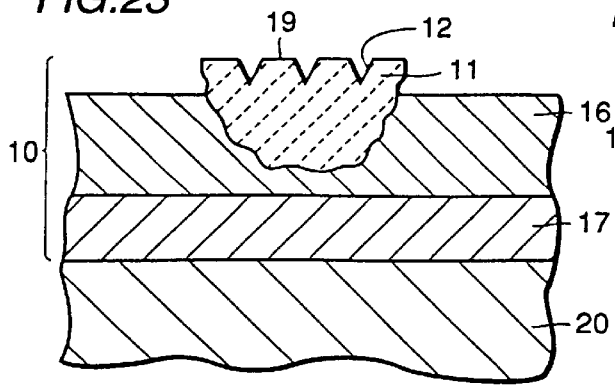
FIG. 23 to FIG. 30 are partial sectional views showing various forms of grooves or holes formed on flat surfaces of exposed surfaces of superabrasive grains that project from holding layers and are flattened in accordance with the present invention.
Figure 24:
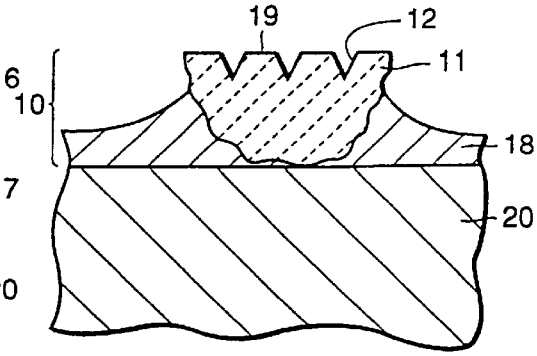
Figure 25:
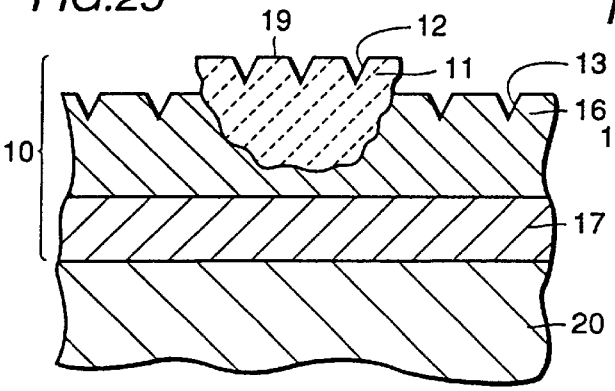
Figure 26:
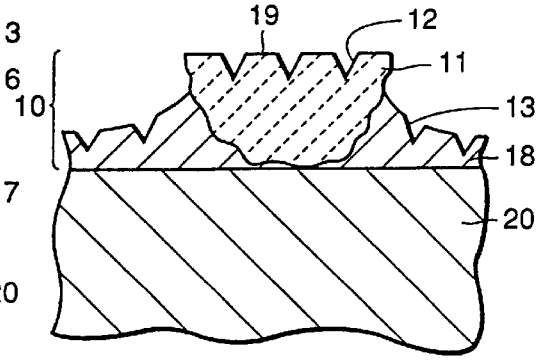
Figure 27:
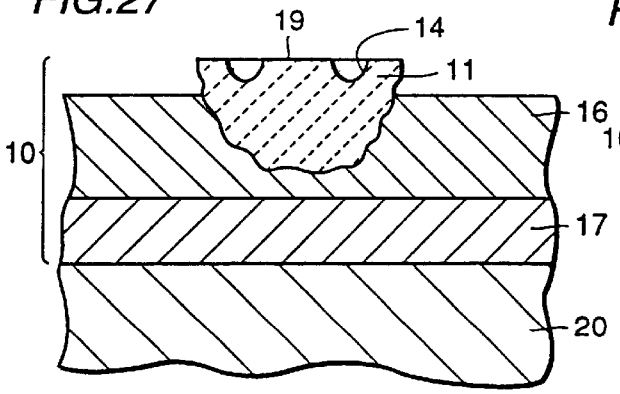
Figure 28:
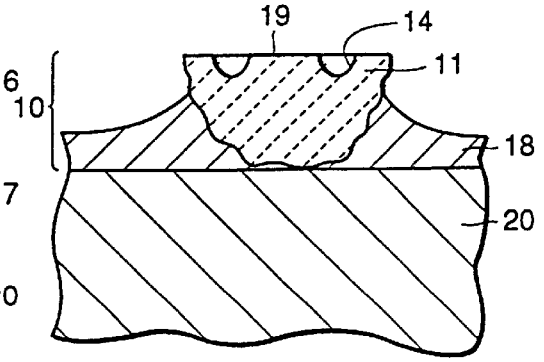
Figure 29:
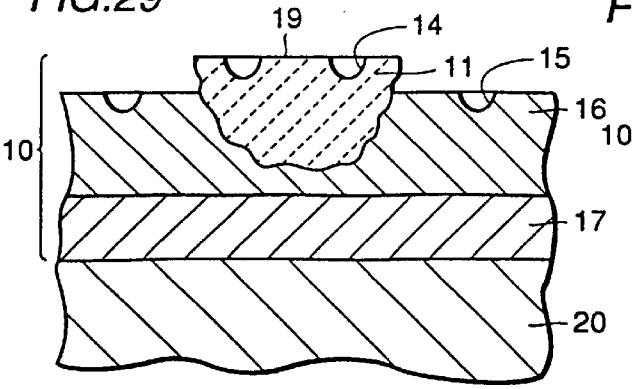
Figure 30:
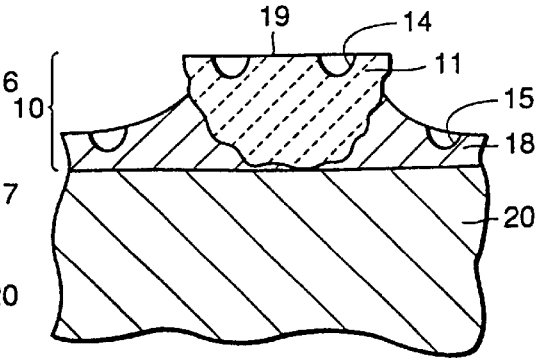

As shown in FIG. 23 and FIG. 24, grooves 12 are formed only on the flat surfaces 19 of the superabrasive grains 11. As shown in FIG. 25 and FIG. 26, not only grooves 12 are formed on the flat surfaces 19 of the superabrasive grains 11, but also grooves 13 are formed on a surface of the nickel plating layer 16 or the brazing filler metal layer 18 serving as the holding layer. As shown in FIG. 27 and FIG. 28, holes 14 are formed on the flat surfaces 19 of the superabrasive grains 11. As shown in FIG. 29 and FIG. 30, not only holes 14 are formed on the flat surfaces 19 of the superabrasive grains 11, but also holes 15 are formed on a surface of the nickel plating layer 16 or the brazing filler metal layer 18 serving as the holding layer.

Various forms of grooves or holes in such cases when exposed surfaces of superabrasive grains 11 are on the same plane as surfaces of nickel plating layers 16 or brazing filler metal layers 18 as shown in FIG. 31 to FIG. 38 are described. In embodiments shown in FIG. 31, FIG. 33, FIG. 35 and FIG. 37, the superabrasive layers 10 comprise the superabrasive grains 11, the nickel plating layers 16 holding the superabrasive grains 11, and bond layers 17 fixing the nickel plating layers 16 to the bases 20. In embodiments shown in FIG. 32, FIG. 34, FIG. 36 and FIG. 38, on the other hand, the superabrasive layers 10 comprise the superabrasive grains 11, and the brazing filler metal layers 18 holding and fixing the superabrasive grains 11 to the bases 20.

Figure 31:
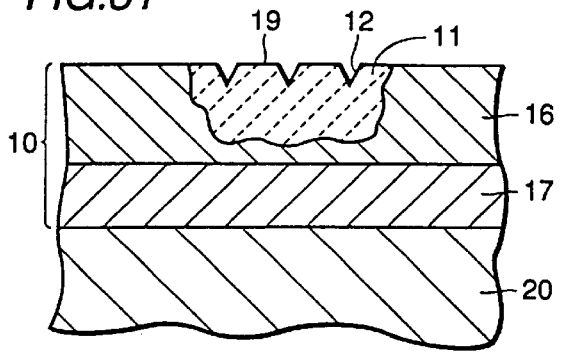
FIG. 31 to FIG. 38 are partial sectional views showing various forms of grooves or holes formed on exposed surfaces of superabrasive grains and/or exposed surfaces of holding layers in accordance with the present invention when the exposed surfaces of the superabrasive grains and the holding layer are on the same plane.
Figure 32:
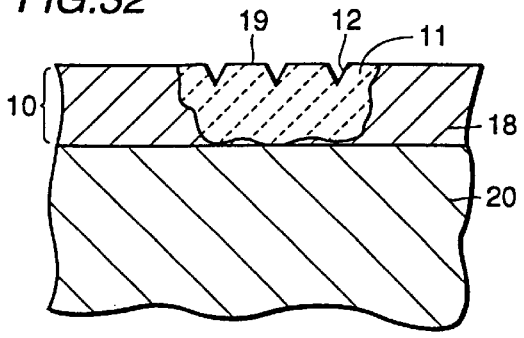
Figure 33:
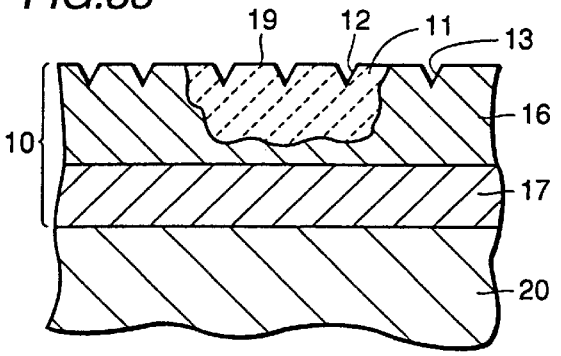
Figure 34:
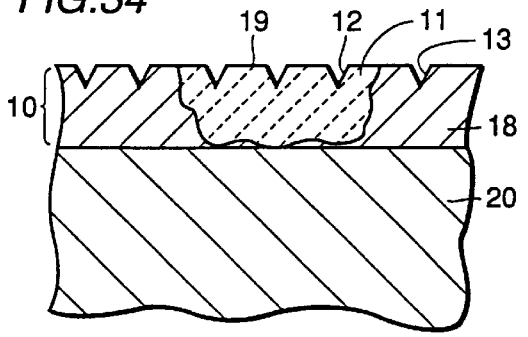
Figure 35:
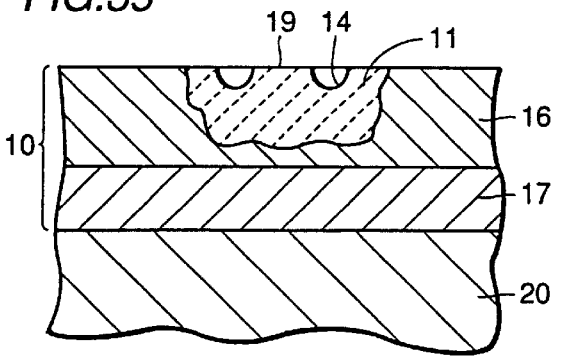
Figure 36:
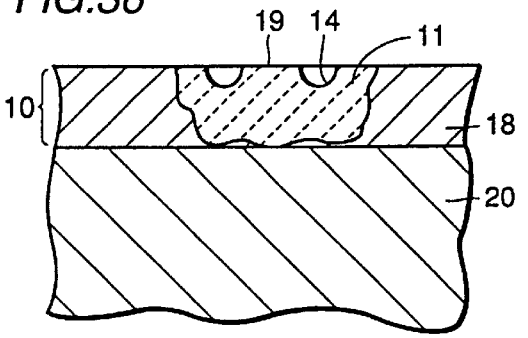
Figure 37:
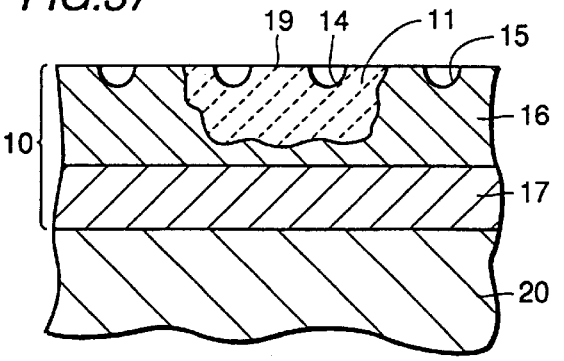
Figure 38:
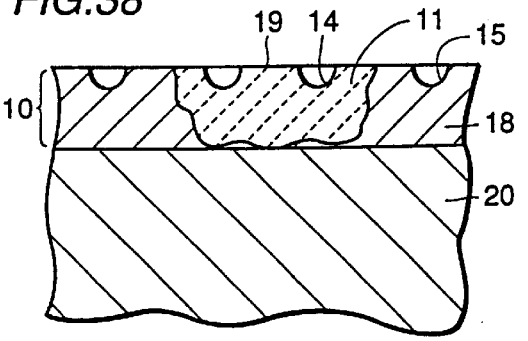

As shown in FIG. 31 and FIG. 32, grooves 12 are formed on flat surfaces 19 of the superabrasive grains 11. As shown in FIG. 33 and FIG. 34, grooves 12 are formed on flat surfaces 19 of the superabrasive grains 11, and grooves 13 are formed on a surface of the nickel plating layer 16 or the brazing filler metal layer 18 serving as the holding layer. As shown in FIG. 35 and FIG. 36, holes 14 are formed on flat surfaces 19 of the superabrasive grains 11. As shown in FIG. 37 and FIG. 38, holes 14 are formed on flat surfaces 19 of the superabrasive grains 11, and holes 15 are formed on a surface of the nickel plating layer 16 or the brazing filler metal layer 18 serving as the holding layer.

Embodiments of the arrangement of grooves formed on superabrasive layers of superabrasive tools will now be described. In the embodiment shown in FIG. 39, grooves 12 are formed only on exposed surfaces of superabrasive grains 11. The large number of grooves 12 are formed to be orthogonal to each other, and arranged in the form of lines defining clearances on a go board or a checkerboard. The distances between the large number of grooves 12 extending in the transverse direction in parallel with each other and the large number of grooves 12 extending in the vertical direction in parallel with each other, i.e., a groove-to-groove pitch P is set at a prescribed value so that the grooves in the form of lines defining clearances on a go board or checkerboard are formed by irradiating the same with a laser beam.

Figure 40:
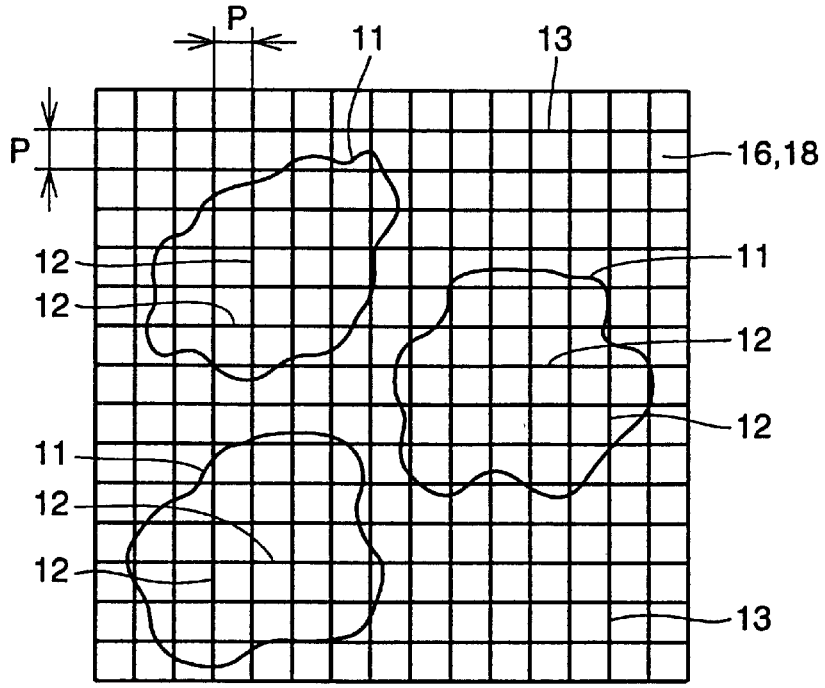

In the embodiment shown in FIG. 40, a large number of grooves 12 extending in the vertical direction and in the transverse direction in the form of lines defining clearances on a go board or checkerboard are formed to extend not only on exposed surfaces of superabrasive grains 11 but on a surface of a nickel plating layer 16 or a brazing filler metal layer 18 serving as the holding layer.

Figure 41:
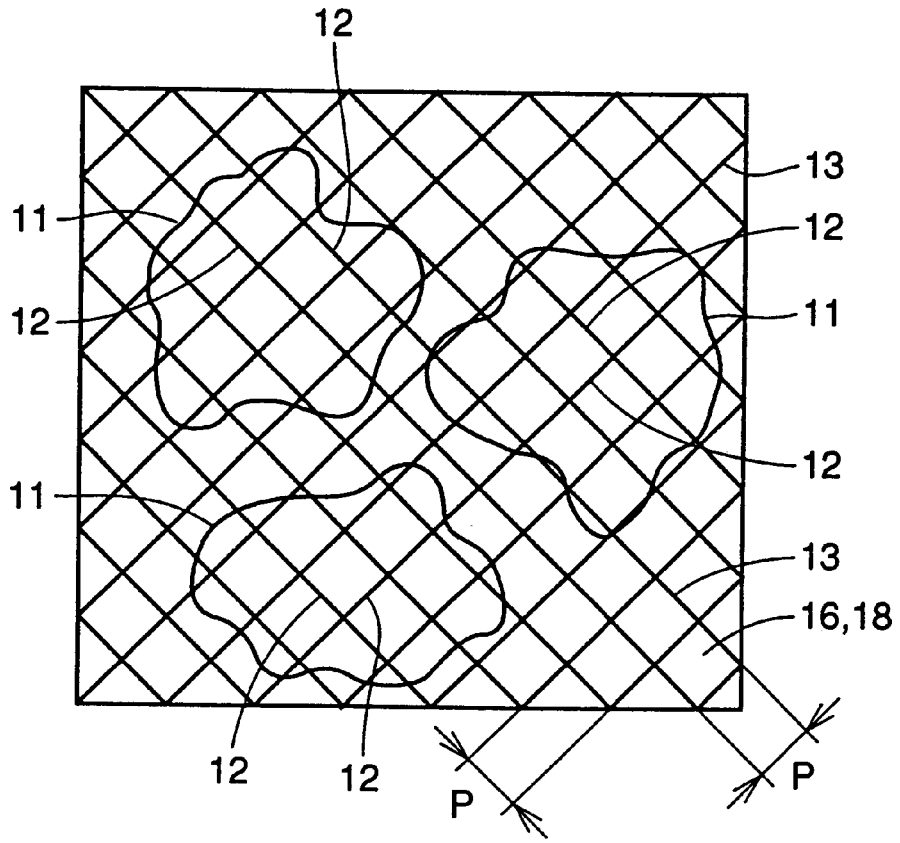

As shown in FIG. 41, further, a large number of grooves 12 extending in oblique directions to intersect with each other may be formed to extend on exposed surfaces of superabrasive grains 11 and a surface of a nickel plating layer 16 or a brazing filler metal layer 18 serving as the holding layer. In this case, too, the distances between the grooves 12 extending in parallel with each other, i.e., a groove-to-groove pitch P is set at a prescribed value and grooves in the form of lines defining clearances on a go board or checkerboard are formed by applying a laser beam while relatively moving the same by a prescribed interval at a time.

EXAMPLE 1

Figure 43:
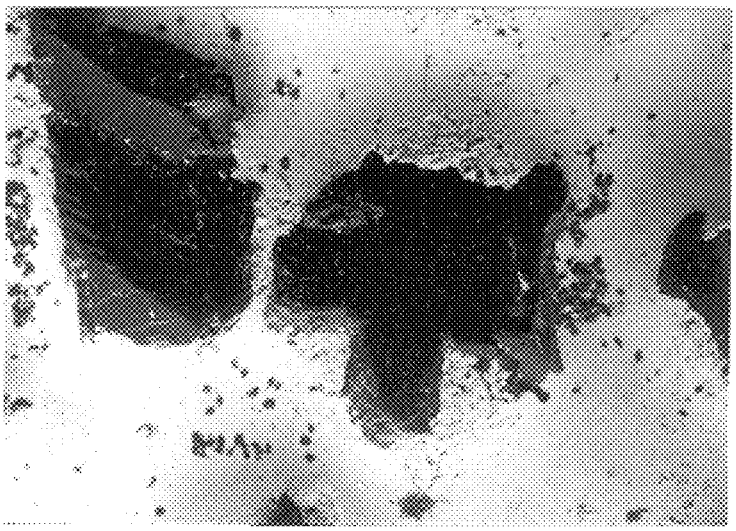
FIG. 43 is a microphotograph showing a state of an abrasive surface after truing the abrasive surface in the superabrasive grindstone of Example 1 and before irradiating the same with a laser beam.

The cup-type superabrasive grindstone 101 shown in FIG. 1 and FIG. 2 was prepared. The diameter D of the grindstone was 125 mm, and the width $W_1$ of the abrasive surface was 7 mm. Diamond grains of #18/20 in grain size (800 to 1000 μm in grain size) were employed as the superabrasive grains. The superabrasive layer 10 was formed by holding and fixing the diamond grains on the base of the grindstone by nickel plating. Thereafter the surface of each superabrasive grain 11 projecting from the nickel plating layer 16 was trued (a thickness of about 30 μm was removed from the grain 11) with a diamond grindstone of #120 in grain size for forming the flat surface 19, as shown in FIG. 23. A microphotograph (magnification: 40) showing a state after truing the abrasive surface is shown in FIG. 43.

Figure 39:
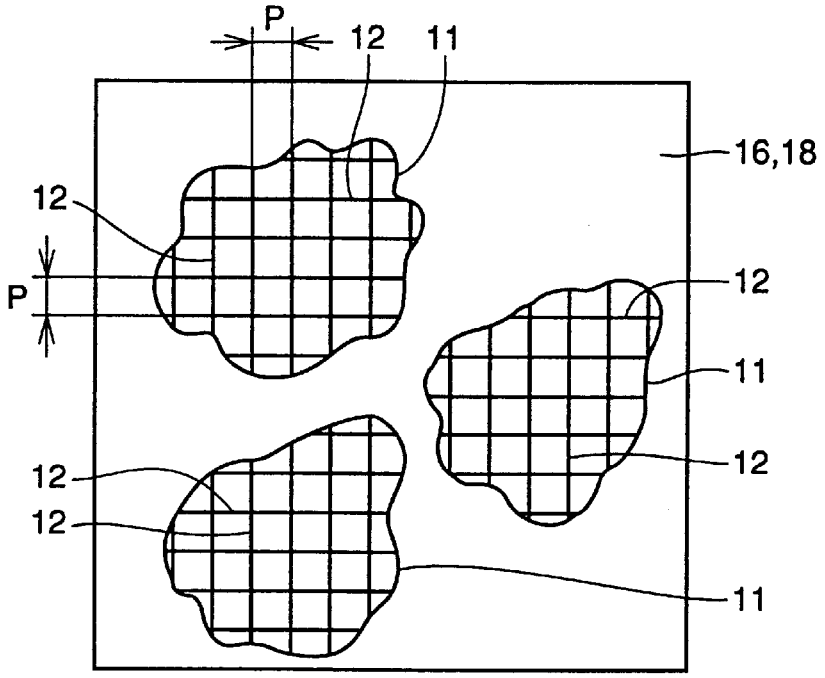
FIG. 39 to FIG. 41 are partial plan views showing arrangements of grooves formed on exposed surfaces of superabrasive grains and/or exposed surfaces of holding layers in accordance with the present invention.

Thereafter the surface of the superabrasive layer 10 was irradiated with the laser beam 50 from the laser beam machining unit 40 in the normal direction as shown in FIG. 11. As to the laser beam irradiation conditions to this abrasive surface, the input value was set at 5 kHz and the output was set at 2.5 W with a YAG laser. The grooves 12 were formed on the flat surface 19 of the superabrasive grain 11 by this laser beam irradiation, as shown in FIG. 23. Further, grooves at the groove-to-groove pitch P of 50 μm including 16 to 20 grooves extending in the same direction in parallel with each other were formed by setting the irradiation pitch of the laser beam at 50 μm and setting the pitch number at 16 to 20, as shown in FIG. 39. The formation of the grooves by laser beam irradiation was performed by rotating the cup-type superabrasive grindstone 101 shown in FIG. 1 about the mounting shaft hole 30 at a peripheral speed of 250 to 500 mm/min.

Figure 42:
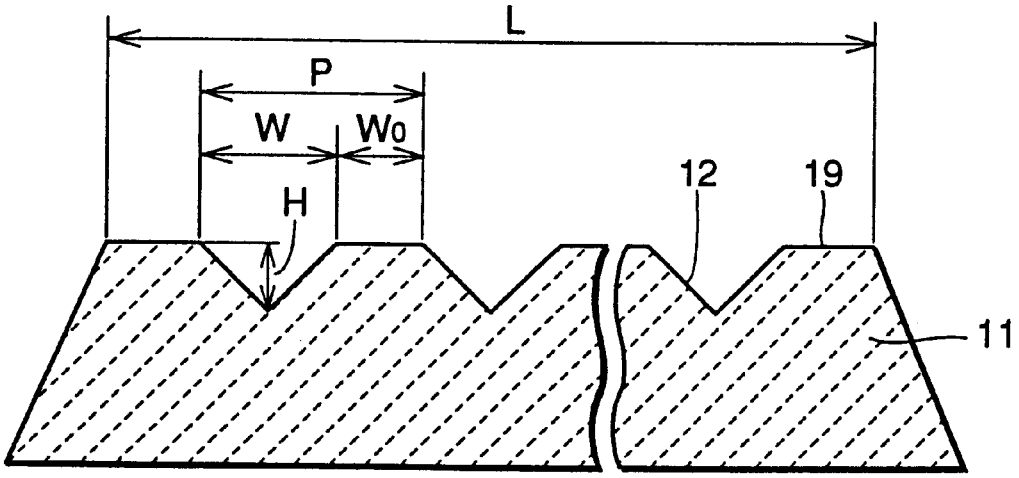
FIG. 42 is an enlarged partial sectional view showing a projecting end surface of a superabrasive grain in a superabrasive grindstone of Example 1.

Sections of the grooves 12 formed on the flat surface 19 of the superabrasive grain 11 in the aforementioned manner are shown in FIG. 42. The groove-to-groove pitch P was 50 μm, the width W of the grooves was 30 μm, the length $W_0$ of the flat parts between the grooves was 20 μm, the length L of the flat surface was 800 to 1000 μm, and the depth H of the grooves was 14 to 18 μm.

Figure 44:
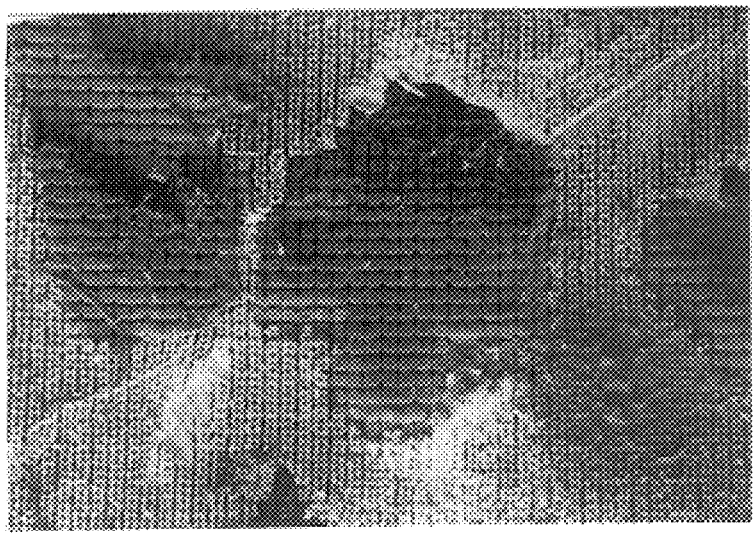
FIG. 44 is a microphotograph showing a state of the abrasive surface after being irradiated with a laser beam in the superabrasive grindstone of Example 1.

In correspondence to FIG. 39, a microphotograph (magnification: 40) showing the arrangement of the grooves formed by irradiating the abrasive surface after truing with the laser beam is shown in FIG. 44. Referring to FIG. 44, those areas appearing black are flat surfaces of diamond grains. Where regular grooves have been formed by laser beam irradiation, flat areas of 20 μm square serve as cutting edges as can be seen in the form of clear lines defining clearances on a go board or checkerboard. Crushed material can be partially seen.

These parts in the form of lines defining clearances on a go board or checkerboard form an insert or a flat drag, and grinding progresses while causing fine chips similarly to a grindstone employing fine grains. The chips and the grinding fluid smoothly flow through the space between the projecting portion of the superabrasive grain 11 and the nickel plating layer 16 and the spaces of the grooves 12 formed on the flat surface 19 of the superabrasive grain 11 in the section shown in FIG. 23. Moreover, the superabrasive grain 11 is a coarse grain which is deeply and tightly held by the nickel plating layer 16, whereby no hindrance results from the grains dropping out of the holding layer.

The depth and the width of the grooves, the number, presence/absence of intersection of the grooves, whether or not the intersection angles between the grooves are equalized with each other on the right and left sides and the like can be freely selected in response to the workpiece, grinding conditions and the like.

As hereinabove described, the superabrasive grindstone of the present invention brings the structure of the abrasive surface into a specific structure, and hence it is necessary to bring the superabrasive grains into one layer.

When the projecting end surfaces of the superabrasive grains are not flat surfaces, the laser beam is applied after forming flat surfaces by performing truing. Therefore, the grain sizes of the superabrasive grains may not necessarily be substantially uniformly regular, and the amounts of projection thereof may not be regular.

If the grain sizes of the superabrasive grains are not substantially uniformly regular, however, prescribed function/effect cannot be sufficiently attained due to the fact that the number of superabrasive grains on which grooves cannot be formed on the flat surfaces of the superabrasive grains increases. When the amounts of projection of the superabrasive grains are substantially uniformly regular, it is easy to perform truing, and there is such an effect that prescribed grooves can be formed even if the amount of removal by truing is small, or without performing truing as the case may be. As the inventors have proposed in Japanese Patent Laying-Open No. 8-229828, therefore, it is preferable to manufacture a grindstone with regularized amounts of projection of superabrasive grains and to perform grooving by irradiating its abrasive surface with a laser beam.

EXAMPLE 2

Figure 45:
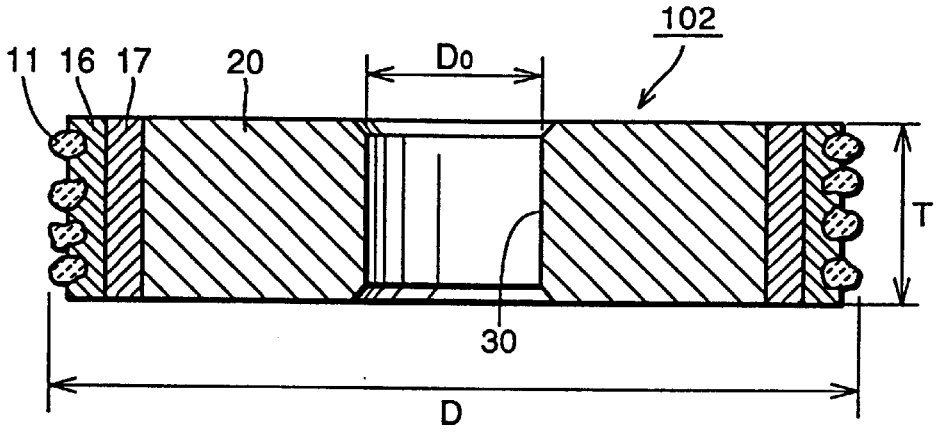
FIG. 45 is a diagram showing a longitudinal sectional side surface before performing truing in a superabrasive grindstone of Example 2.
Figure 46:
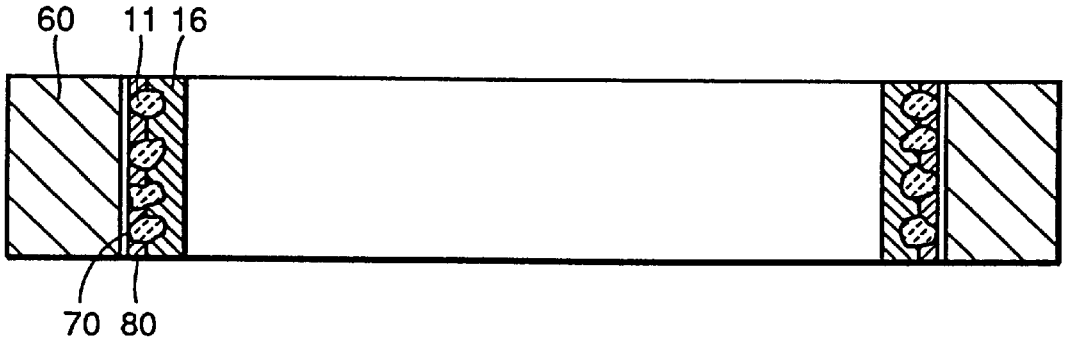
FIG. 46 is a sectional view showing a superabrasive layer employed for illustrating a manufacturing step for the superabrasive grindstone of Example 2.
Figure 47:
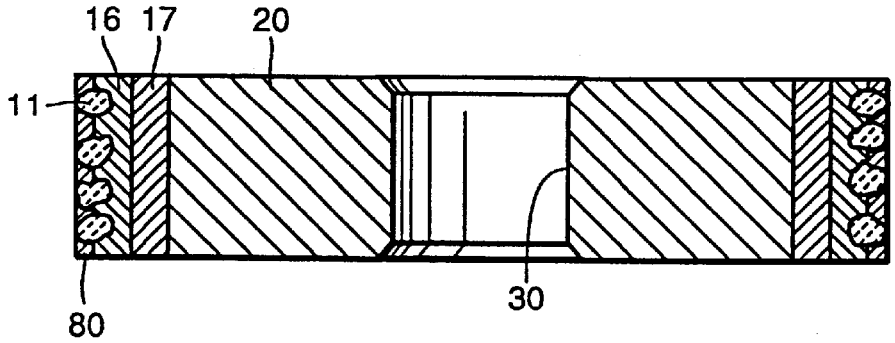
FIG. 47 is a sectional view showing the superabrasive layer employed for illustrating a manufacturing step after FIG. 46 in the superabrasive grind-stone of Example 2.

FIG. 45 is a diagram showing a longitudinal sectional side surface of a straight-type superabrasive grindstone 102 before performing truing. FIG. 46 and FIG. 47 are sectional views showing a superabrasive layer employed for illustrating manufacturing steps for substantially regularizing the amounts of projection of superabrasive grains. A manufacturing method for regularizing the amounts of projection of the superabrasive grains will now be described with reference to these drawings.

As shown in FIG. 46, superabrasive grains 11 consisting of diamond grains of #30/40 in grain size are spread and held in one layer on a surface of a mold 60 of carbon with a conductive adhesive layer 70 such as synthetic resin containing powder of copper. A copper plating layer 80 of 60 to 100 μm in thickness was formed by dipping this mold 60 in a plating solution of copper as such or after hardening the resin by heating. Then, the plating solution was exchanged and a nickel plating layer 16 of 1.5 mm in thickness completely covering the superabrasive grains 11 was formed on the copper plating layer 80.

Respective conditions of the copper plating and the nickel plating were as follows:

Copper Plating

Composition of Solution copper pyrophosphate: 75 to 105 g/l metal copper: 26 to 36 g/l potassium pyrophosphate: 280 to 370 g/l aqueous ammonia: 2 to 5 cc/l brightener: 1 to 4 cc/l Plating Conditions current density: 0.2 $A/dm^2$ temperature: 45 to 50° C.

Nickel Plating

Composition of Solution nickel sulfate: 250 g/l nickel chloride: 45 g/l boric acid: 40 g/l brightener: 1 g/l Plating Conditions current density: 1 A/dm$^2$ temperature: 45 to 50° C.

Then, the nickel plating layer 16 was integrally bonded to the outer edge of a base 20 of steel with a bond layer 17 consisting of a low melting point alloy, and thereafter the mold 60 was broken and removed, as shown in FIG. 47. The thickness of the bond layer 17, which was set at 2 mm, can be increased/reduced as needed. Further, the mold 60 may be removed before bonding of the nickel plating layer 16 and the base 20.

Thereafter the overall base 20, or only the plated part was dipped in an etching solution of copper for dissolving/removing the copper plating layer 80. In this case, the etching, which was performed by electrolytic etching, can also be performed by chemical etching. At this time, the nickel plating layer 16 is not dissolved, holding of the superabrasive grains 11 by the nickel plating layer 16 is strong, and only a previously set thickness part of the copper plating layer 80 is completely dissolved/removed, whereby substantially uniform amounts of projection of the superabrasive grains 11 are ensured. If any remainder of the resin of the conductive adhesive is recognized on the surface of the copper plating layer 80, this resin may be removed by heating decomposition or machining. While the method of sticking the superabrasive grains 11 to the mold 60 with the conductive adhesive has been described in the aforementioned Example, superabrasive grains such as diamond grains may be floated in the plating solution for bonding the superabrasive grains to the surface of the mold with formation of the plating layer.

The longitudinal sectional side surface of the straight-type superabrasive grindstone 102 formed in the aforementioned manner is shown in FIG. 45. As shown in FIG. 45, the superabrasive grains 11 consisting of diamond grains of #30/40 in grain size (602 $\mu$m in mean grain size) substantially uniformly projected from the surface of the nickel plating layer 16 of about 1.5 mm in thickness with projection heights of 60 to 100 $\mu$m. The bond layer 17 integrally bonding the nickel plating layer 16 and the outer edge of the base 20 of steel was a layer of about 2 mm in thickness consisting of a low melting point alloy. Further, the nickel plating layer 16 sufficiently tightly fixed the superabrasive grains 11 with no loosening of a portion around the superabrasive grains 11. The diameter D of the straight-type superabrasive grindstone 102 was 70 mm, the hole diameter $D_0$ of the mounting shaft hole 30 was 35 mm, and the thickness T was 22 mm.

A flat surface was formed on an abrasive surface of the straight-type superabrasive grindstone manufactured in the aforementioned manner directly or by truing similarly to Example 1, and thereafter a laser beam was applied for forming grooves on the projecting surfaces of the superabrasive grains. In this case, the irradiation direction of the laser beam 50 may be either in the normal direction or in the tangential direction with respect to the superabrasive layer, as shown in FIG. 13.

The shape accuracy, the roundness and the surface roughness of a fixing surface of the mold 60 on which the superabrasive grains 11 are fixed by the copper plating layer 80 are reflected in the uniformity of the projecting heights of the superabrasive grains 11 as such. Therefore, it is important to pay attention to various parameters of the mold 60, such as the selection of material for the mold, working of the mold, surface finishing of the mold, and the like. Incidentally, the projecting heights of the superabrasive grains 11 were substantially uniform when employing a mold prepared by finishing the shape accuracy and the roundness within 1.5 $\mu$m and the surface roughness within 1.5 $\mu$m Rmax by grinding the fixing surface of the mold 60.

Figure 48:
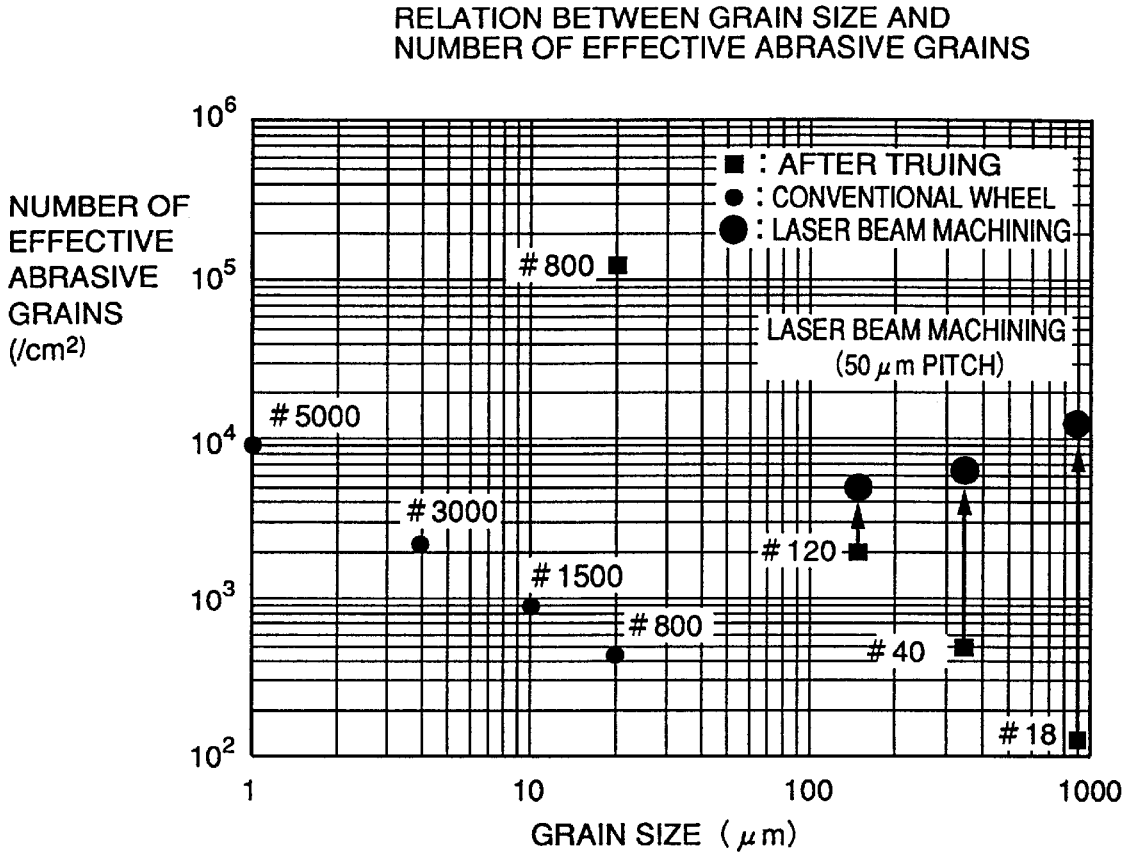
FIG. 48 is a diagram showing the relations between the grain sizes of superabrasive grains and the number of effective abrasive grains in conventional superabrasive grindstones and superabrasive grindstones according to the present invention.

FIG. 48 is a graph by a logarithmic scale showing the relations between the grain sizes ($\mu$m) of the superabrasive grains and the numbers of the effective abrasive grains (/cm$^2$) of conventional superabrasive grindstones and of superabrasive grindstones manufactured in accordance with Example 2, respectively. Referring to FIG. 48, black squares indicate measurement results showing the relations between the grain sizes of the superabrasive grains and the numbers of the effective abrasive grains before forming the grooves in accordance with Example 2. Namely, the data for the black squares were measured in relation to superabrasive grindstones that were substantially uniformly regularized with respect to the amounts of projection of the superabrasive grains and uniformalized with respect to the heights of the projecting end surfaces. With respect to this, it is understood that the projecting end surfaces are divided and the numbers of the effective abrasive grains increase, as shown by the large black circles when the amounts of projection of the superabrasive grains are regularized, the heights of the projecting end surfaces are uniformalized, and grooves are thereafter formed by irradiation with laser beams, in accordance with the present invention. Small black circles reflect measurements in relation to the conventional superabrasive grindstones (conventional wheels). "After truing" shows the results measured in relation to superabrasive grindstones before forming the grooves in Example 2, and "laser beam machining" shows the results measured in relation to superabrasive grindstones after forming grooves in accordance with Example 2.

Thus, it is possible to implement an effective abrasive grain number equivalent to fine grains or exceeding the same in the superabrasive grindstone of the present invention employing coarse grains as superabrasive grains. This means that an abrasive space including chip pockets of each superabrasive grain is increased, and contributes to the effect of improving the sharpness of the grindstone and the grinding accuracy.

EXAMPLE 3

The cup-type superabrasive grindstone 101 shown in FIG. 1 and FIG. 2 was prepared. The diameter D of the cup-type superabrasive grindstone 101 was 125 mm, and the width $W_1$ of the abrasive surface was 7 mm. Diamond grains of #18/20 in grain size (800 to 1000 $\mu$m in grain size) were employed as the superabrasive grains. These diamond grains were fixed to the base of the grindstone by a nickel plating layer as the holding layer.

Flat surfaces were formed by truing exposed surfaces of the diamond grains with a diamond grindstone of #120 in grain size so that projecting surfaces of the fixed diamond grains were on the same plane as the surface of the nickel plating layer. Thereafter continuous grooves were formed on the flat surfaces of the diamond grains serving as the superabrasive grains and the surface of the nickel plating layer serving as the holding layer by irradiating the flat surfaces with the laser beam 50 from the normal direction as shown in FIG. 11 while rotating the grindstone at a peripheral speed of 250 to 500 mm/min. A YAG laser was employed for the laser beam. As to irradiation conditions of the laser beam, the input value was set at 5 kHz and the output was set at 2.5 W. Thus, grooves 12 were formed on the flat surface 19 of the superabrasive grain 11, and grooves 13 were formed on the surface of the nickel plating layer 16 too, as shown in FIG. 33.

Further, grooves in the form of lines defining clearances on a go board or checkerboard at a groove-to-groove pitch P of 50 $\mu$m including 16 to 20 grooves extending in the same direction in parallel with each other were formed by performing irradiation. The irradiation pitch of the laser beam was set at 50 $\mu$m and the pitch number at 16 to 20, as shown in FIG. 40.

Figure 49:
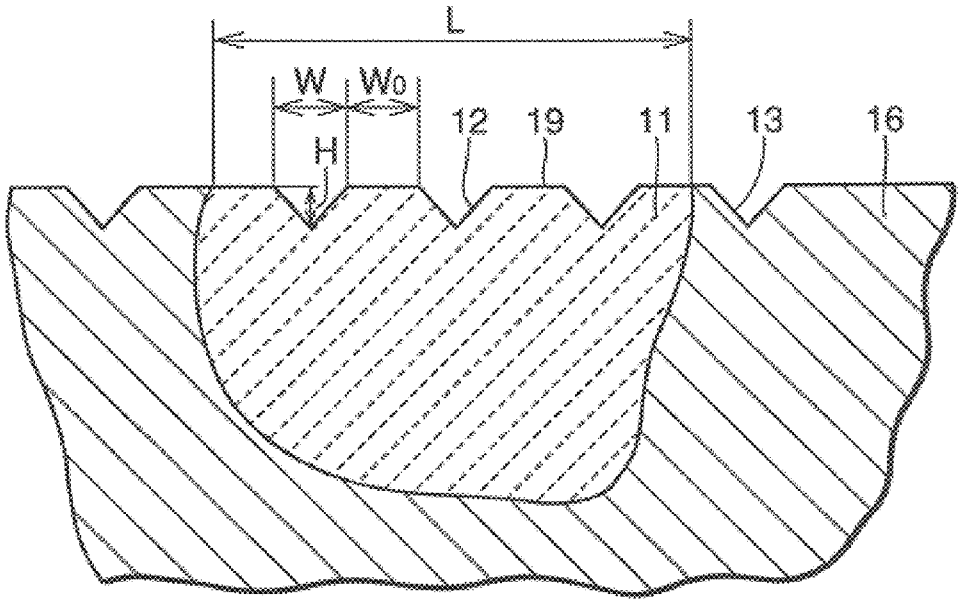
FIG. 49 is a partial sectional view showing a part of a superabrasive layer in a superabrasive grindstone of Example 3.
Figure 50:
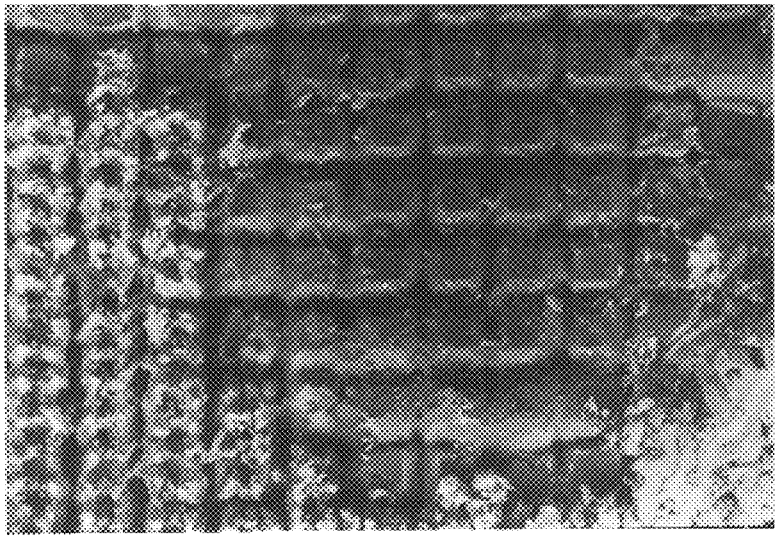
FIG. 50 is a microphotograph showing a state of an abrasive surface of the superabrasive grindstone of Example 3.

As shown in FIG. 49, the grooves 12 were formed on the flat surface 19 of each superabrasive grain 11, and the grooves 13 were formed on the surface of the nickel plating layer 16. The length L of the flat surface of the superabrasive grain 11 was 800 to 1000 $\mu$m, the width W of the grooves was 30 $\mu$m, the depth H of the grooves was 14 to 18 $\mu$m, and the length $W_0$ of the flat parts between the grooves was 20 $\mu$m. FIG. 50 is a microphotograph (magnification: 160) showing the arrangement of grooves formed after truing by irradiating the trued abrasive surface with a laser beam in correspondence to FIG. 40. Those areas appearing gray in FIG. 50 are the flat surfaces of the diamond grains. It is observed that regular grooves are continuously formed by the laser beam on the surface of the nickel plating layer which appears white.

Edges of these grooves act as an insert or a flat drag, and grinding progresses while causing small chips similarly to a grindstone employing diamond grains of fine grains. Moreover, because the diamond grains are coarse grains, they are deeply and strongly held by the nickel plating layer as the holding layer, and consequently, cause no hindrance by dropping from the holding layer.

The depth and the width of the grooves, the number of the grooves, presence/absence of intersection between the grooves, whether or not the intersection angles between the grooves are equalized with each other on the right and left sides and the like can be freely selected in response to the workpiece, grinding conditions and the like.

As hereinabove described, the superabrasive grindstone of the present invention brings the structure of the abrasive surface into a specific structure, and hence it is necessary to bring the superabrasive grains into one layer. When the surface of the superabrasive layer is not a flat surface, the laser beam is applied after forming a flat surface by truing similarly to the aforementioned Example, and hence the grain sizes of the superabrasive grains may not necessarily be regular.

If the grain sizes are not substantially uniformly regular, however, the number of superabrasive grains on which grooves cannot be formed on flat surfaces increases and the prescribed function/effect cannot be sufficiently attained. If the grain sizes of the superabrasive grains are substantially uniformly regular, it is easy to perform truing, and there is such an effect that prescribed grooves can be formed even if the amount of removal by truing is small, or without performing truing as the case may be.

EXAMPLE 4

A diamond rotary dresser was prepared as the straight-type superabrasive dresser 103 shown in FIG. 5 and FIG. 6. The diameter D of the diamond rotary dresser was 80 mm, and the thickness T was 25 mm.

Grooves were formed on the superabrasive layer 10 as shown in FIG. 33. Diamond grains of #50/60 in grain size (grain size: 260 to 320 $\mu$m) were employed as the superabrasive grains 11. The superabrasive grains 11 were held by a nickel plating layer 16 serving as the holding layer, and bonded to the base 20 of steel through the bond layer 17 consisting of a low melting point alloy. The grooves 12 were formed on the flat surface 19 of each superabrasive grain 11, and grooves 13 were formed on the surface of the nickel plating layer 16.

Formation of the grooves 12 and 13 was performed as follows: Projecting exposed surfaces of the superabrasive grains 11 were trued with a diamond grindstone by a thickness of 3 $\mu$m, and so worked that the flat surfaces 19 of the superabrasive grains 11 and the surface of the nickel plating layer 16 were flush with each other. Thereafter the grooves were formed by irradiating the surface of the superabrasive layer 10 with the laser beam 50 from the tangential direction, as shown in FIG. 13. A YAG laser was employed for the laser beam. The output of the laser beam was 40 W. The grooves were formed by applying the laser beam while rotating the dresser at a peripheral speed of 250 to 500 mm/min. The shape of the grooves thus formed was as follows: They were screw-shaped grooves whose groove pitch was 0.5 mm, the opening width of the grooves was 0.03 to 0.08 mm, and the depth of the grooves was 0.03 mm.

In order to confirm the performance of the diamond rotary dresser manufactured in the aforementioned manner, a conventional grindstone mounted on a horizontal spindle surface grinding machine was dressed with the diamond rotary dresser under the following conditions: As to the grinding machine, a horizontal spindle surface grinding machine by Okamoto Machine Tool Works, Ltd. was employed. As to the driver for the diamond rotary dresser, the driver SGS-50 by Osaka Diamond Industrial Co., Ltd. was employed. As to the shape of the dressed conventional grindstone, the outer diameter was 300 mm and the thickness was 10 mm, and its type was WA80K (type of JIS). As to the dressing conditions, the peripheral speed ratio was 0.28 (down-dressing), the cutting speed was 1.9 mm/min., and the cutting amount was 4 mm.

The resistance value in the aforementioned dressing was compared with that of an ungrooved conventional diamond rotary dresser. The dressing resistance value of the conventional diamond rotary dresser with no grooves was 4.0N/10 mm in the normal direction and 0.5N/10 mm in the tangential direction. On the other hand, the dressing resistance value of the diamond rotary dresser manufactured according to this Example was 2.5N/10 mm in the normal direction and 0.25N/10 mm in the tangential direction.

Thus, the diamond rotary dresser of the present invention subjected to grooving by laser beam irradiation, showed a resistance value in dressing reduced at least by 40 to 50% as compared with the conventional product and was capable of smooth dressing without causing vibration. The accuracy of the dressed grindstone was also excellent.

EXAMPLE 5

A diamond rotary dresser was prepared as the straight-type abrasive dresser 103 shown in FIG. 5 and FIG. 6. The diameter D of the diamond rotary dresser was 80 mm, and the thickness T was 25 mm.

The grooves shown in FIG. 24 were formed on the exposed surface of the superabrasive layer. The grooves 12 were formed on the flat surface 19 of each superabrasive grain 11 consisting of a diamond grain. The superabrasive grain 11 was fixed to the base 20 through the brazing filler metal layer 18 consisting of an Ag—Cu—Ti system alloy.

In Example 5, the grain sizes of the superabrasive grains 11, the shape of the grooves 12 and the shape and the material of the base 20 are similar to Example 4. The distinguishing feature is that the superabrasive grains 11 were directly fixed to the base 20 with the brazing filler metal layer 18.

This fixation was performed by applying a paste brazing filler metal to a surface of a base material 18, manually arranging the superabrasive grains 11, thereafter introducing the same into a furnace, melting the brazing filler metal by heating, and thereafter cooling the same. Therefore, while in example 4 the exposed surfaces of the superabrasive grains 11 are substantially on the same plane as the surface of the nickel plating layer 16 (refer to FIG. 33), the exposed surfaces of the superabrasive grains 11 as shown in FIG. 24 project from the surface of the brazing filler metal layer 18 serving as the holding layer. End surfaces of the projecting superabrasive grains 11 were flattened by truing, and grooves were formed on the flat surfaces by applying a laser beam similarly to Example 4. In this case, it is also possible to omit the truing.

This brazing type diamond rotary dresser has such excellent characteristics that elimination of chips in dressing is smoothly performed, and not only is dressing resistance low, but also there is no occurrence of clogging since the amounts of projection of the diamond grains are large as compared with the diamond rotary dresser of Example 4 and abrasive grain spaces are extremely enlarged.

Further, because a forward end portion of a cutting edge of each diamond grain of the superabrasive grain 11 is increased to a plurality of cutting edges, i.e., the effective abrasive grain number is increased due to formation of the grooves 12 and consequently, sharpness and accuracy also improve. Incidentally, in case of dressing employing the diamond rotary dresser manufactured in accordance with Example 5, it was possible to reduce the required dressing time at least by about 30% as compared with dressing by a conventional product.

The Ag—Cu—Ti system activated brazing filler metal employed as the brazing filler metal in Example 5 is excellent in that the same can readily strongly fix the diamond and the steel forming the base. However, the hardness of the brazing filler metal is at a low level of about Hv 100, and hence, there is the risk that the brazing filler metal surface will be gradually eroded by contact of chips. Although this will cause no abrasion on the diamond grains in dressing, the brazing filler metal will finally drop the diamond grains which will rapidly reduce the life of the diamond rotary dresser.

Accordingly, an effective way of improving wear resistance of the brazing filler metal is to introduce hard grains into the brazing filler metal, in order to prevent the brazing filler metal from being eroded by the chips. It is possible to prevent erosion of the brazing filler metal by introducing at least a single type of diamond, CBN, SiC abrasive grains, $Al_2O_3$ abrasive grains, WC grains and the like into the brazing filler metal as the hard grains. Grain sizes should not be more than ½ that of the diamond grains employed for the rotary dresser. The ratio of these hard grains is within the range of 10 to 50 volume % with respect to the volume of the brazing filler metal, and preferably within the range of 30 to 50 volume %.

Example 4 is also executable by forming the nickel plating layer by the so-called inversion plating method similarly to Example 2 and providing grooves on the nickel plating layer. Further, the superabrasive layer according to the present invention can be formed also by forming grooves on the layer formed as the holding layer by sintering metal powder or alloy powder known as metal bond. However, a dresser comprising a mode of fixing superabrasive grains with a brazing filler metal as shown in Example 5 can attain the highest dressing accuracy, and its dressing resistance is low. Further, a rotary dresser fixing superabrasive grains with a brazing filler metal layer has long life, and it is possible to reduce its manufacturing time too.

EXAMPLE 6

A diamond rotary dresser was manufactured as the superabrasive dresser 104 as shown in FIG. 7. Diamond grains of #50/60 in grain size (grain size: 260 to 320 $\mu$m) were employed as the superabrasive grains. A nickel plating layer was employed as the holding layer, for holding the superabrasive grains in a single layer with the so-called inversion plating method as shown in Example 2, and bonding the same to the base of steel.

Grooves were formed by performing truing on the surface of the superabrasive layer positioned on the shoulder portion 21 of the dresser 104 in FIG. 7 to a thickness of 3 $\mu$m and thereafter applying the laser beam while rotating the dresser at a peripheral speed of 250 to 500 mm/min. As shown in FIG. 13, the laser beam 50 was applied to the superabrasive layer in the tangential direction. A YAG laser was employed for the laser beam. The output of the laser beam was 40 W. As shown in FIG. 33, the grooves 12 were formed on the flat surface 19 of each superabrasive grain 11, and grooves 13 were formed on the surface of the nickel plating layer 16. They were screw-shaped grooves at a groove pitch of 0.3 mm, the opening width of the grooves was 0.03 to 0.08 mm, and the depth of the grooves was 0.03 mm.

A microphotograph (magnification: 200) showing the arrangement of the grooves formed in the shape of lines defining clearances on a go board or checkerboard by laser beam irradiation was similar to that shown in FIG. 50.

Figure 51:
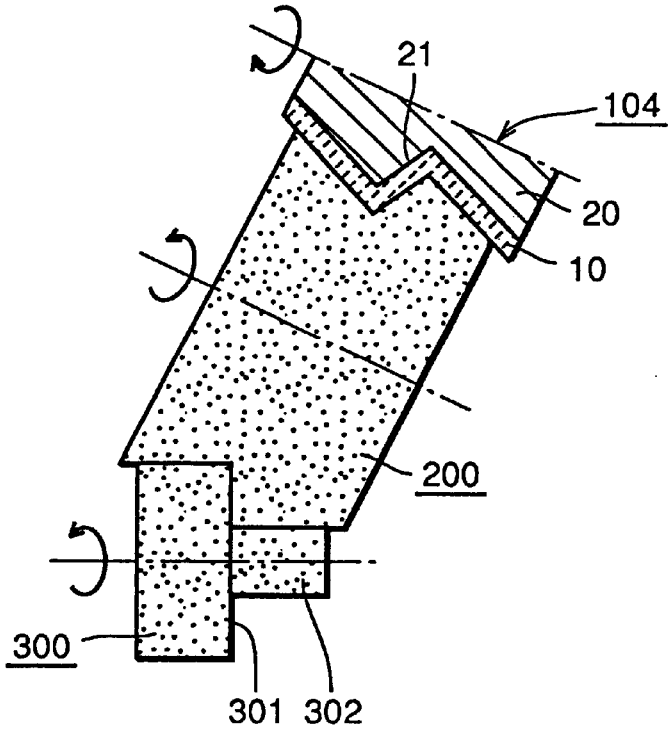
FIG. 51 is a diagram showing a mode of performing dressing with a diamond rotary dresser in Example 6.

In order to confirm the performance of the manufactured diamond rotary dresser, the dresser 104 was arranged as shown in FIG. 51 for dressing a grindstone 200. A workpiece 300 was ground with the WA (type of JIS) grindstone 200 of 300 mm in outer diameter, while the grindstone 200 was dressed with the diamond rotary dresser 104 of 120 mm in outer diameter. The superabrasive layer 10 is formed on the outer peripheral surface of the base 20 of the diamond rotary dresser 104. The grooves are formed on the shoulder portion 21 of the superabrasive layer 10 in the aforementioned manner. The outer peripheral shape of the grindstone 200 is formed in correspondence to stepped portions 301 and 302 of the workpiece 300. Arrows shown in FIG. 51 show rotational directions of the workpiece 300, the grindstone 200 and the diamond rotary dresser 104 respectively. The dressed conventional grindstone was WA80K in the type of JIS. As to the dressing conditions, the peripheral speed ratio was 0.3 (down-dressing), the cutting speed was 1.0 mm/min., and the cutting amount was 4 mm.

The resistance value in dressing in Example 6 was compared with that of an ungrooved conventional diamond rotary dresser. The dressing resistance value of the conventional diamond rotary dresser with no grooves was 6.0N/10 mm in the normal direction, and 0.8N/10 mm in the tangential direction. On the other hand, the dressing resistance value of the diamond rotary dresser of Example 6 was 4.0N/10 mm in the normal direction, and 0.4N/10 mm in the tangential direction.

EXAMPLE 7

A diamond rotary dresser was manufactured as the superabrasive dresser 105 having the outer peripheral shape shown in FIG. 8. Manufacturing of the dresser 105 and formation of grooves were performed similarly to Example 6. The grooves were formed by irradiating only the end surfaces 22 and 23 of the dresser 105 shown in FIG. 8 with a laser beam from the tangential direction. A schematic section of the superabrasive layer formed with the grooves is as shown in FIG. 33.

In order to confirm the performance of the dresser manufactured in this manner, a conventional grindstone was dressed with the dresser manufactured in Example 7 in conditions similar to Example 6.

Figure 52:
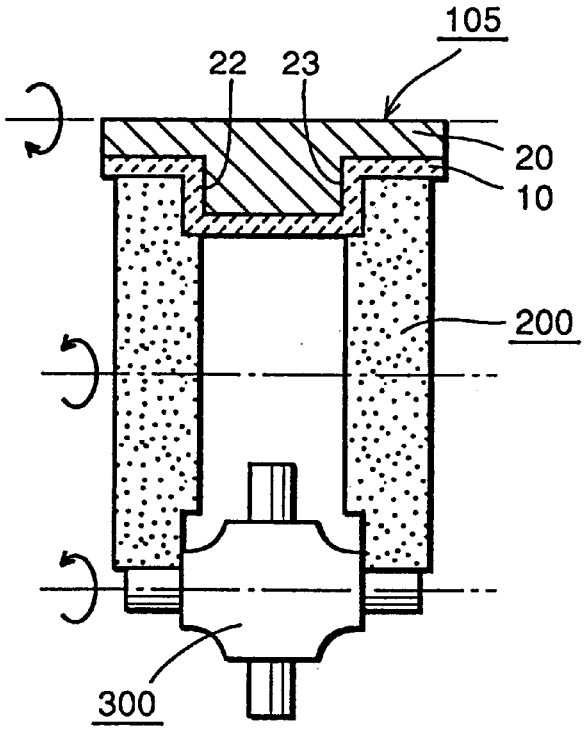
FIG. 52 is a diagram showing a mode of performing dressing with a diamond rotary dresser in Example 7.

As shown in FIG. 52, the diamond rotary dresser was arranged as a superabrasive dresser 105 of 150 mm in diameter. A workpiece 300 was ground with a conventional grindstone 200 of WA or GC (type of JIS) having an outer diameter of 355 mm, while the grindstone 200 was dressed with the diamond rotary dresser 105 of 150 mm in outer diameter. The superabrasive layer 10 is formed on the outer peripheral surface of the base 20 of the diamond rotary dresser 105. The grooves are formed only on the end surfaces 22 and 23 of the superabrasive layers 10 with a laser beam as described above.

The dressing resistance value of the diamond rotary dresser of Example 7 was also reduced as compared with the dressing resistance value of a conventional diamond rotary dresser having no grooves, similarly to Example 6.

Thus, in the inventive diamond rotary dresser subjected to grooving by laser beam irradiation, the resistance value in dressing was reduced by at least 30 to 50% as compared with the conventional product, no vibration was caused, and smooth dressing was possible. Further, accuracy of the dressed grindstone was also excellent.

EXAMPLE 8

Diamond rotary dressers 104 and 105 of shapes similar to Examples 6 and 7 were manufactured while changing the holding layers from the nickel plating layers to brazing filler metal layers.

A schematic section of a superabrasive layer formed with grooves is as shown in FIG. 24. The grooves 12 are formed on a flat surface 19 of each superabrasive grain 11 consisting of a diamond grain. The superabrasive grain 11 is held by a brazing filler metal layer 18 consisting of an Ag—Cu—Ti alloy, and fixed to a base 20. The grain size of the diamond grain, the shape of the grooves 12 and the shape and the material of the base 20 are similar to Examples 6 and 7. A distinguishing feature is that the diamond grain was directly fixed to the base 20 by the brazing filler metal layer 18 as the superabrasive grain.

This fixation was performed by applying a paste brazing filler metal to the base 20, manually placing the diamond grains, introducing the same into a furnace, melting the brazing filler metal by heating, and thereafter cooling the same. Therefore, while in Examples 6 and 7 as shown in FIG. 33 the exposed surface of each superabrasive grain 11 is substantially on the same plane as the nickel plating layer 16 as the holding layer, in Example 8 as shown in FIG. 24 the exposed surface of each superabrasive grain 11 projects from the surface of the brazing filler metal layer 18 serving as the holding layer. The grooves were formed by flattening the projecting forward end portions by truing and irradiating the flat surfaces with a laser beam similarly to Examples 6 and 7. The truing may be omitted as the case may be.

In the brazing type diamond rotary dresser manufactured in this manner, the amount of projection of the diamond grains is large as compared with Examples 6 and 7 as described above and an abrasive space is extremely enlarged. Elimination of chips in dressing is smoothly performed, and dresser has such excellent characteristics that not only is the dressing resistance low, but there is no occurrence of clogging.

Due to formation of the grooves 12, further, the forward end portion of a cutting edge of each superabrasive grain 11 is increased to a plurality of cutting edges, i.e., the effective abrasive grain number is increased, whereby sharpness and accuracy improve.

The Ag—Cu—Ti activated brazing filler metal employed as the brazing filler metal in Example 8 is excellent in that it can readily strongly fix the diamond and the steel forming the base. However, the hardness of the brazing filler metal is at a low level of about Hv 100, and hence there is risk that this brazing filler metal will be gradually eroded from its surface by contact of chips. Although this causes no abrasion on the diamond grains in dressing, it will finally cause the filler metal to drop the diamond grains, which will rapidly reduce the life of the diamond rotary dresser.

Accordingly, an effective measure to prevent the brazing filler metal from being eroded by the chips is to introduce hard grains into the brazing filler metal to improve wear resistance of the brazing filler metal. It is possible to prevent erosion of the brazing filler metal by introducing at least one type of hard grain such as diamond, CBN, SiC, $Al_2O_3$, WC and the like into the brazing filler metal. The grain sizes of these hard grains should not be more than ½ that of the diamond grains employed for formation of the abrasive surface. The ratio of these hard grains should be within the range of 10 to 50 volume % with respect to the volume of the brazing filler metal, and preferably within the range of 30 to 50 volume %.

The diamond rotary dresser of the present invention can be manufactured by forming a nickel plating layer by the inversion plating method and forming grooves on a superabrasive layer similarly to Examples 6 and 7, or by sintering metal powder or alloy powder known as metal bond for forming a holding layer and forming grooves on a superabrasive layer. However, the brazing type diamond rotary dresser fixing the superabrasive grains with the brazing filler metal layer as described above has the highest dressing accuracy and its dressing resistance is also low. Moreover, it is possible to reduce the manufacturing time of the dresser by selectively flattening only a prescribed portion in a dressing operating surface, e.g., only a shoulder portion or an end surface and selectively performing grooving. Further, a composited dressing operating surface of a higher degree can be formed by changing the grain sizes of the employed superabrasive grains, the degree of concentration and the like between this selected portion and the remaining portions.

As described above, the dresser of the present invention brings the structure of the dressing operating surface into a specific structure, and hence it is necessary to bring the superabrasive grains into one layer.

If the surface of the superabrasive layer is not a flat surface, a flat surface is formed by truing and thereafter irradiated with a laser beam, and hence the grain sizes of the superabrasive grains may not necessarily be uniformly regular.

If the grain sizes of the superabrasive grains are not substantially uniformly regular, however, the number of superabrasive grains on which grooves on flat surfaces cannot be formed increases and the prescribed function/effect may not be attained. When the grain sizes of the superabrasive grains are substantially uniformly regular, it is easy to perform truing, and prescribed grooves can be formed even if the amount of removal by truing is small, or without performing truing as the case may be. Further, it is also possible to recycle the dresser by irradiating with a laser beam and forming grooves only on a prescribed portion of the superabrasive layer of the dresser whose sharpness decreases with use.

EXAMPLE 9

A diamond lap surface plate was manufactured as the superabrasive lap surface plate 106 shown in FIG. 9 and FIG. 10. The diameter D of the diamond lap surface plate 106 was 300 mm, and the thickness T was 30 mm. A superabrasive layer was fixed onto the surface of the base 20 by one layer.

Figure 53:
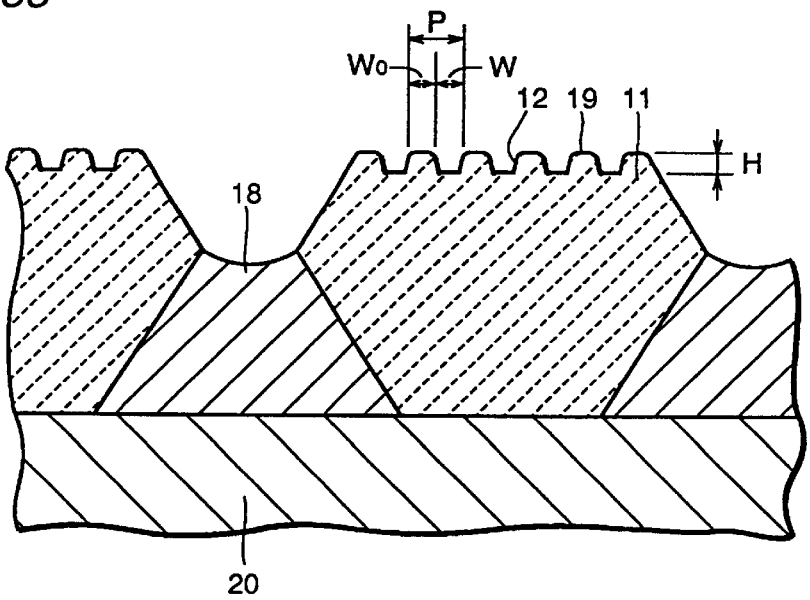
FIG. 53 is a partial sectional view showing a section of a diamond layer in a diamond lap surface plate of Examples 9 and 10.

As shown in FIG. 53, grooves 12 were formed on flat surfaces 19 of superabrasive grains 11 consisting of diamond grains of #30/40 (grain size: 430 to 650 $\mu$m) in grain size. The superabrasive grains 11 were fixed onto the base 20 by a brazing filler metal layer 18.

Fixation of the superabrasive grains 11 was performed by applying a paste brazing filler metal to the base 20, arranging diamond as the superabrasive grains in the brazing filler metal and introducing the base 20 into a furnace, melting the brazing filler metal by heating and thereafter cooling the base 20. Therefore, projecting end surfaces of the superabrasive grains 11 projected beyond the surface of the brazing filler metal layer 18 as a holding layer. The forward end portions of the projecting superabrasive grains 11 were flattened by truing, and the flat surfaces were irradiated with a laser beam for forming the grooves.

Figure 14:
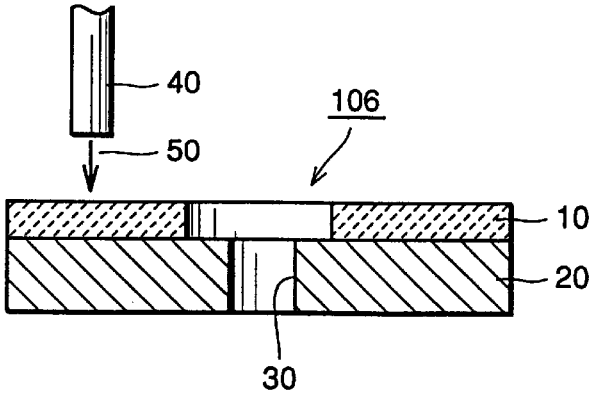
FIG. 14 is a model diagram showing laser beam machining in case of irradiating an abrasive surface of the lap surface plate to which the present invention is applied with a laser beam in a normal direction.

Formation of the grooves was performed by applying the laser beam 50 in the normal direction with respect to the surface of the superabrasive layer 10 as shown in FIG. 14. A YAG laser was employed for the laser beam. The output of the laser beam was 2.5 W.

The grooves 12 arranged as shown in FIG. 39 were formed by applying the laser beam in the form of meshes. Thus, the groove-to-groove pitch P was 25 $\mu$m, t he width W of the grooves was 20 $\mu$m, the depth H of the grooves was 20 $\mu$m, and the length $W_0$ of the flat parts between the grooves was 5 $\mu$m, as shown in FIG. 53.

In the diamond lap surface plate manufactured in this manner, the diamond grains themselves scratch a workpiece, whereby high accuracy lapping was enabled in high efficiency without supplying free abrasive grains dissimilarly to a conventional lap surface plate of spherical graphite cast iron. Namely, the diamond lap surface plate of the present invention has such an excellent characteristic that sludge is hardly generated. This is because the sludge contains only a slight amount of chips resulting from the workpiece when the workpiece is lapped. Thus, amount of sludge generated is extremely small. This enables not only working in clean environment but also the amount of environmental pollution generated is small.

Further, the diamond lap surface plate of the present invention is extremely excellent in wear resistance as compared with the conventional lap surface plate of spherical graphite cast iron. Furthermore, its hardness is uniform, and ability of the lap surface plate to maintain plane accuracy is also extremely high since its surface contains diamond grains as superabrasive grains. Therefore, it can stably bring high plane accuracy and high parallel accuracy to a lapped workpiece over a long period.

In addition, the diamond lap surface plate of the present invention has absolutely no defect corresponding to a cast defect which is regarded as the largest problem in the lap surface plate of spherical graphite cast iron. Therefore, no scratch results from a defect.

Figure 54:
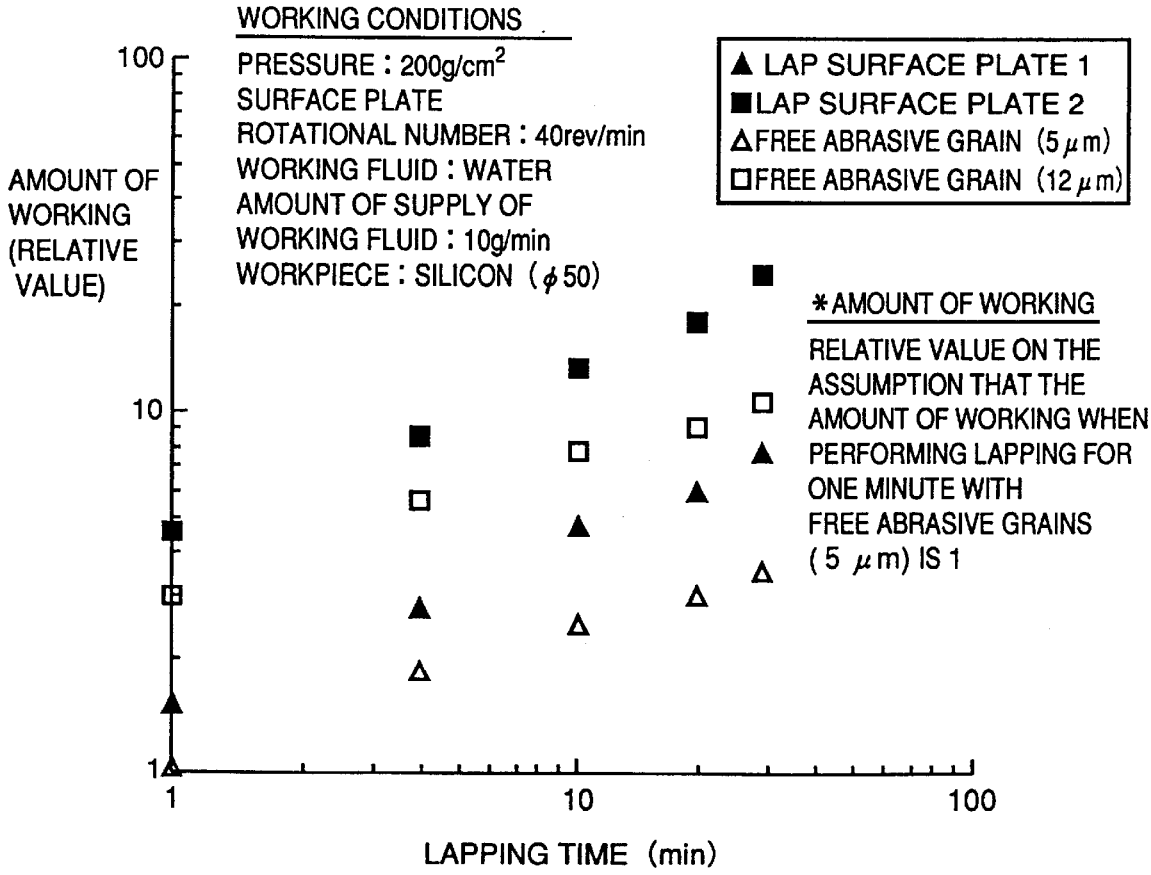
FIG. 54 is a diagram showing comparison of working speeds of lapping between Examples 9 and 10 and a conventional one.

In order to confirm the performance of the diamond lap surface plate manufactured in Example 9, a comparative experiment with a conventional lap surface plate was performed. FIG. 54 shows results obtained by mounting this diamond lap surface plate on a lapping machine and lapping a silicon wafer.

The lapping shown in FIG. 54 was performed in the following working conditions: The pressure was set at 200 g/cm$^2$, the rotational number was set at 40 rev/min., the working fluid was prepared from water, the amount of supply of the working fluid was set at 10 cc/min., and the workpiece was prepared from a silicon wafer of 50 mm in diameter.

Referring to FIG. 54, black triangles designating "lap surface plate 1" show measurement results achieved with the diamond lap surface plate of Example 9 . According to these results, the working speed by the diamond lap surface plate of Example 9 was about three times the working speed by a conventional lap surface plate of spherical graphite cast iron employing alumina of 5 $\mu$m in grain size as free abrasive grains. Further, surface roughness of the silicon wafer after lapping was also excellent.

EXAMPLE 10

The diamond lap surface plate shown in FIG. 9 and FIG. 10 was manufactured similarly to Example 9. As to features different from the diamond lap surface plate of Example 9 , the groove-to-groove pitch P was 35 $\mu$m, and the length $W_0$ of the flat parts between the grooves was 15 $\mu$m in FIG. 53. The remaining shape and dimensions of the diamond lap surface plate, the forming method and the dimensions of the grooves and the like were rendered similar to Example 9.

In order to confirm the performance of the diamond lap surface plate of Example 10 , a silicon wafer was lapped in conditions similar to Example 9 . Results thereof are shown in FIG. 54. Referring to FIG. 54, black squares designating "lap surface plate 2" show measurement results achieved with the diamond lap surface plate of Example 10.

As apparent from FIG. 54, the working speed by the diamond lap surface plate of Example 10 was about three times the working speed by a conventional lap surface plate of spherical graphite cast iron employing alumina of 12 $\mu$m in grain size as free abrasive grains. Further, surface roughness of the silicon wafer after lapping was also excellent.

EXAMPLE 11

The cup-type superabrasive grindstone 101 as shown in FIG. 1 and FIG. 2 was manufactured. The diameter D of the grindstone was 125 mm, and the width $W_1$ of the abrasive surface was 7 mm. Diamond grains of #18/20 (mean grain size: 900 $\mu$m) in grain size were employed as the superabrasive grains. The superabrasive grains were fixed to the surface of the base 20 by a nickel plating layer.

Flat surfaces were formed by removing forward end portions of the superabrasive grains with a diamond grindstone of #120 in grain size by a thickness of 30 $\mu$m. Thereafter a laser beam was intermittently applied with respect to the surface of the superabrasive layer 10 in the normal direction as shown in FIG. 11, thereby forming holes on the flat surfaces of the superabrasive grains. A YAG laser was employed for the laser beam. The output of the laser beam was 2.5 W.

Figure 55:
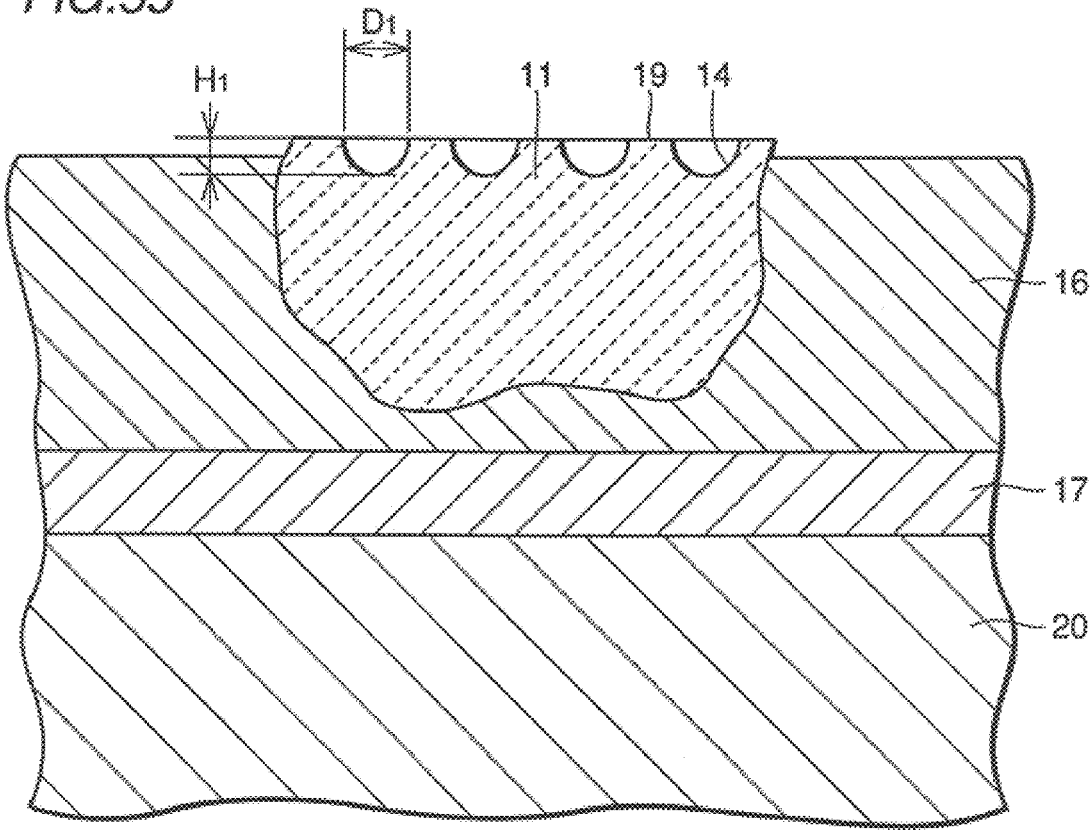
FIG. 55 is a partial sectional view showing a section of a superabrasive layer of a superabrasive tool formed with holes.

A section of the superabrasive layer including holes thus formed is as shown in FIG. 27. The dimensions of the holes are shown in FIG. 55. The diameter $D_1$ of the holes was 50

μm, the depth $H_1$ of the holes was 30 to 50 μm, and the space between the holes 14 was 100 μm. Namely, the holes 14 were formed on intersections in the form of lines defining clearances on a go board or checkerboard at the pitch of 100 μm.

Grinding performance was confirmed by employing the cup-type superabrasive grindstone manufactured in the aforementioned manner. A vertical spindle surface grinding machine was employed as a grinding machine, and a silicon single crystal was employed as a workpiece. When employing the cup-type superabrasive grindstone of the present invention formed with the holes, grinding resistance was reduced by 20 to 30% as compared with a cup-type superabrasive grindstone having no holes.

EXAMPLE 12

A diamond rotary dresser was manufactured as the superabrasive dresser 103 shown in FIG. 5 and FIG. 6. The diameter D of the dresser was 80 mm, and the thickness T was 20 mm. Diamond grains of #50/60 (mean grain size: 300 μm) in grain size were employed as the superabrasive grains. A fixation method of the superabrasive grains to the base 20 was performed by the so-called inversion plating method shown in Example 2.

Holes were formed on flat surfaces of the superabrasive grains by intermittently applying a laser beam with respect to the superabrasive layer 10 in the vertical direction as shown in FIG. 12. A YAG laser was employed for the laser beam. The output of the laser beam was 2.5 W.

The superabrasive layer 10 having the holes 14 as shown in FIG. 27 was formed in this manner. The diameter $D_1$ of the holes was 50 μm, the depth $H_1$ of the holes was 30 to 50 μm, and the pitch between the holes 14 was 100 μm, as shown in FIG. 55.

The performance was confirmed by employing the diamond rotary dresser manufactured in the aforementioned manner. A horizontal spindle surface grinding machine was employed as a grinding machine. As to the driver for the diamond rotary dresser, one by Osaka Diamond Industrial Co., Ltd. (type SGS-50 type) was employed. WA80K (JIS type) was employed as the grindstone of the dressed object, the diameter of the grindstone was 300 mm, and the width was 15 mm. As to dressing conditions, the peripheral speed ratio was 0.3, and the cutting speed was 2 mm/min.

According to the rotary dresser of the present invention comprising holes, the dressing resistance value was reduced by 20 to 30% as compared with the conventional rotary dresser.

In the stages of fixing the superabrasive grains to the bases and forming the superabrasive layers in the aforementioned Examples 11 and 12, truing for substantially uniformly regularizing the heights of the projecting parts of the superabrasive grains was performed and thereafter application of laser beams was intermittently performed at the pitches of 100 μm, for forming holes on the flat surfaces of the superabrasive grains while changing the positions. Single or plural holes were formed on the forward end portions of the exposed superabrasive grains in Examples 11 and 12. However, holes can be formed to extend over the boundaries between the exposed portions of the superabrasive grains and the exposed portion of the nickel plating layer serving as the holding layer forming the superabrasive layer and on the exposed portion of the holding layer in application of the laser beam. A superabrasive tool which is further excellent in performance can be obtained by thus forming the holes on the overall surface of the superabrasive layer.

Figure 56:
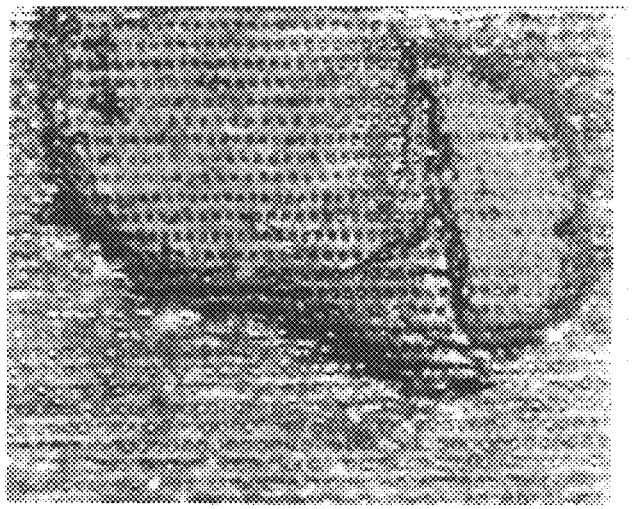
FIG. 56 is a microphotograph showing a surface of the superabrasive layer of the superabrasive tool formed with the holes.

FIG. 56 is a microphotograph (magnification: 50) showing the arrangement of holes formed on a superabrasive layer according to an Example different from the aforementioned Examples. Referring to FIG. 56, the area in a black frame appearing in the form of a peninsula from the upper portion is a superabrasive grain, and the small individual, scatteredly appearing black areas in the superabrasive grain are holes. The holes are formed also on the surface of the nickel plating layer. Therefore, the holes 14 may be formed only on the flat surface 19 of the superabrasive grain 11 as in FIG. 27, or the holes 14 may be formed on the flat surface 19 of the superabrasive grain 11 and the holes 15 may be also formed on the surface of the nickel plating layer 16 as shown in FIG. 29.

Recycling of a tool is also enabled by forming holes in a superabrasive layer of a superabrasive tool whose sharpness reduces by use, by irradiating the same with a laser beam.

EXAMPLE 13

The diamond rotary dressers 103 shown in FIG. 5 and FIG. 6 were manufactured. The diameter D of the dressers was 100 mm, and the thickness T was 15 mm. Dressers employing respective ones of two types of diamond grains of #30/40 (grain size 400 to 600 μm) in grain size and #50/60 (grain size 250 to 320 μm) in grain size as the superabrasive grains were manufactured. Nickel plating layers were employed as the holding layers. The superabrasive grains were fixed onto bases so that exposed surfaces of the superabrasive grains projected from surfaces of the nickel plating layers, and thereafter truing was performed on the forward end portions of the superabrasive grains with a diamond grindstone of #120 in grain size. Thereafter the laser beam 50 was applied with respect to the superabrasive layers from the tangential direction as shown in FIG. 13 while rotating the dressers at a peripheral speed of 250 to 500 mm/min., thereby forming screw-shaped grooves. Two types of respective dressers were manufactured as groove-to-groove pitches of 0.3 mm and 0.5 mm. The depth of the grooves was 20 μm, and the width of the grooves was 20 μm.

Conventional grindstones were dressed with four types of diamond rotary dressers manufactured by rendering the grain sizes of the tional grindstones, and the cutting amount was set at 0.02 mm. Further, dressing-out was set at 1 sec.

Measurement results of dressing resistance values are shown in Table 1.

TABLE 1

Change of Dressing Resistance (unit: KW)

| | Diamond Grain Size #30/40 | | Diamond Grain Size #50/60 | |
|---|---|---|---|---|
| | Pitch 0.5 | Pitch 0.3 | Pitch 0.5 | Pitch 0.3 |
| Before Laser Grooving | 0.30 | 0.30 | 0.30 | 0.30 |
| After Laser Grooving | 0.28 | 0.20 | 0.28 | 0.17 |
| Amount of Change | 0.02 | 0.10 | 0.02 | 0.13 |

As seen in Table 1, the dressing resistance values decrease when the diamond rotary dressers subjected to grooving are employed. It can be seen that the ratio of reduction of the dressing resistance value increases when the groove-to-groove pitch in particular is reduced. It can also be seen that the reduction ratios of the dressing resistance values increase with reduced grain sizes of the diamond grains.

As hereinabove described, the superabrasive tool according to the present invention is useful as a grindstone employing superabrasive grains of diamond, cubic boron nitride (CBN) or the like, a superabrasive dresser utilized for dressing a conventional grindstone or the like mounted on a grinding machine or the like, or a superabrasive lap surface plate employed for lapping of a silicon wafer or the like, and suitable for performing working resistance value increases when the groove-to-groove pitch in particular is reduced. It can also be seen that the reduction ratios of the dressing resistance values increase with reduced grain sizes of the diamond grains.

As hereinabove described, the superabrasive tool according to the present invention is useful as a grindstone employing superabrasive grains of diamond, cubic boron nitride (CBN) or the like, a superabrasive dresser utilized for dressing a conventional grindstone or the like mounted on a grinding machine or the like, or a superabrasive lap surface plate employed for lapping of a silicon wafer or the like, and suitable for performing working of high accuracy in particular.

What is claimed is:

1. A superabrasive tool comprising:

a base (20); and a superabrasive layer (10) formed on said base (20);

wherein said superabrasive layer (10) includes a holding layer (16, 17; 18) that affixes said superabrasive layer (10) to said base (20), and superabrasive grains (11) that are partially embedded and held in said holding layer and that are discretely dispersed and spaced apart from each other so as to form an arrangement of dispersed ones of said superabrasive grains (11) having exposed grain surfaces and of exposed holding layer surface areas of said holding layer exposed between said superabrasive grains, and wherein said exposed grain surfaces have first concavities therein.

2. The superabrasive tool in accordance with claim 1, wherein said first concavities are grooves (12).

3. The superabrasive tool in accordance with claim 1, wherein said first concavities are holes (14).

4. The superabrasive tool in accordance with claim 1, wherein said exposed holding layer surface areas of said holding layer (16, 17; 18) have second concavities (13; 15) therein.

5. The superabrasive tool in accordance with claim 4, wherein said first concavities (12; 14) in said exposed grain surfaces of said superabrasive grains and said second concavities (13; 15) in said exposed holding layer surface areas of said holding layer (16, 17; 18) are continuous with each other from said exposed grain surfaces to said exposed holding layer surface areas.

6. The superabrasive tool in accordance with claim 1, wherein said exposed grain surfaces of said superabrasive grains (11) project and protrude from said holding layer (16, 17; 18).

7. The superabrasive tool in accordance with claim 6, wherein said exposed grain surfaces of said superabrasive grains (11) are flat planar surfaces (19), and said first concavities (12, 14) are formed on said flat planar surfaces (19).

8. The superabrasive tool in accordance with claim 1, wherein said exposed grain surfaces of said superabrasive grains (11) are flat planar surfaces (19) that are substantially parallel to said exposed holding layer surface areas defining a surface of said holding layer (16, 17; 18).

9. The superabrasive tool in accordance with claim 8, wherein said exposed holding layer surface areas of said holding layer (16, 17; 18) have second concavities (13; 15) therein.

10. The superabrasive tool in accordance with claim 9, wherein said first concavities (12; 14) in said exposed grain surfaces of said superabrasive grains and said second concavities (13; 15) in said exposed holding layer surface areas of said holding layer (16, 17; 18) are continuous with each other from said exposed grain surfaces to said exposed holding layer surface areas.

11. The superabrasive tool in accordance with claim 1, wherein said holding layer includes a plating layer (16).

12. The superabrasive tool in accordance with claim 1, wherein said holding layer includes a brazing filler metal layer (18).

13. The superabrasive tool in accordance with claim 1, wherein said superabrasive tool is a superabrasive grindstone (101; 102).

14. The superabrasive tool in accordance with claim 1, wherein said superabrasive tool is a superabrasive dresser (103; 104; 105).

15. The superabrasive tool in accordance with claim 1, wherein said superabrasive tool is a superabrasive lap surface plate (106).

16. A method of manufacturing a superabrasive tool according to claim 1, comprising the steps of:

forming said holding layer (16, 17; 18) holding and fixing said superabrasive grains (11) on said base (20) so that surfaces of said grains are partially exposed from said holding layer to provide said exposed grain surfaces; and forming said first concavities (12; 14) by irradiating said exposed grain surfaces with a laser beam (150).

17. The method of manufacturing a superabrasive tool in accordance with claim 16, further comprising a step of forming second concavities by irradiating said exposed holding layer surface areas with a laser beam (50).

18. The method of manufacturing a superabrasive tool in accordance with claim 17, wherein said steps of forming said first concavities on said exposed grain surfaces and forming said second concavities on said exposed holding layer surface areas include operations of forming said first and second concavities respectively (12;14, 13; 15) on said exposed grain surfaces and on said exposed holding layer surface areas by continuously irradiating said exposed grain surfaces and said exposed holding layer surface areas with said laser beam (50).

19. The method of manufacturing a superabrasive tool in accordance with claim 16, wherein said step of forming said first concavities (12; 14) includes an operation of forming first concavities (12; 14) by irradiating with said laser beam (50) said exposed grain surfaces of said superabrasive grains (11) that project from said holding layer (16, 17; 18).

20. The method of manufacturing a superabrasive tool in accordance with claim 16, further comprising a step of substantially uniformly flattening said exposed grain surfaces of said superabrasive grains (11) to form uniformly flat surfaces (19) of said grains exposed from said holding layer (16, 17; 18), and wherein said step of forming said first concavities (12; 14) includes irradiating said uniformly flat surfaces (19) with said laser beam (50).

21. The method of manufacturing a superabrasive tool in accordance with claim 20, wherein said step of flattening said exposed grain surfaces is carried out so that said exposed grain surfaces form a plane substantially parallel to a surface of said holding layer (16, 17; 18) defined by said exposed holding layer surface areas.

22. The method of manufacturing a superabrasive tool in accordance with claim 21, further comprising a step of forming second concavities (13; 15) by irradiating said exposed holding layer surface areas of said holding layer (16, 17; 18) with a laser beam, wherein said steps of forming said first and second concavities respectively (12; 14, 13; 15) on said exposed grain surfaces and on said exposed holding layer surface areas include operations of continuously forming said first and second concavities (12; 14, 13; 15) on said uniformly flat surfaces (19) of said exposed grain surfaces and on said exposed holding layer surface areas by continuously irradiating said exposed grain surfaces and said exposed holding layer surface areas with said laser beam (50).

23. The method of manufacturing a superabrasive tool in accordance with claim 16, wherein said step of forming said holding layer includes an operation of forming a plating layer (16).

24. The method of manufacturing a superabrasive tool in accordance with claim 23, wherein said step of forming said holding layer includes the steps of:

sticking said superabrasive grains (11) to a surface of a mold (60) with a conductive adhesive layer (70), forming a first plating layer (80) of a first metal that partially covers said exposed grain surfaces of said superabrasive grains (11) in a first plating layer thickness of less than ½ a mean grain size of said superabrasive grains (11) by dipping said mold (60) to which said superabrasive grains (11) are stuck in a plating solution of said first metal, forming a second plating layer (16) of a second metal being different from said first metal with a second plating layer thickness that completely covers holding surfaces of said superabrasive grains (11) on said first plating layer (80) of said first metal, fixing said second plating layer (16) of said second metal to said base (20) by a bond layer (17), removing said mold (60) from said superabrasive grains (11), and removing said first plating layer (80) of said first metal by etching and partially uniformly exposing said exposed grain surfaces of said superabrasive grains (11).

25. The method of manufacturing a superabrasive tool in accordance with claim 16, wherein said step of forming said holding layer includes an operation of forming a brazing filler metal layer (18).

* * * * *

UNITED STATES PATENT AND TRADEMARK OFFICE

CERTIFICATE OF CORRECTION

PATENT NO. : 6,312,324 B1
DATED : November 6, 2001
INVENTOR(S) : Mitsui et al.

It is certified that error appears in the above-identified patent and that said Letters Patent is hereby corrected as shown below:

Title page,
Under item [56], References Cited, following U.S. PATENT DOCUMENTS, insert the following:

-- FOREIGN PATENT DOCUMENTS

| | | |
|---|---|---|
| 54 029188A | 03/1979 | (JP) |
| 58 094968A | 06/1983 | (JP) |
| 59 047162A | 03/1984 | (JP) |
| 60 104652A | 06/1985 | (JP) |
| 03 196976A | 08/1991 | (JP) |
| 04 210381A | 07/1992 | (JP) |
| 07 096461A | 04/1995 | (JP) |
| 08 155838A | 06/1996 | (JP) |
| 08 206960A | 08/1996 | (JP) |
| 08 229828A | 09/1996 | (JP) --. |

Column 11,
Line 30, after "superabrasive", replace "grind-stone" by -- grindstone --.

Column 25,
Line 36, after "25 μm", replace "t he" by -- the --.

Column 28,
Lines 40 to 43, please replace these lines to read as follows:

-- Conventional grindstones were dressed with four types of diamond rotary dressers manufactured by rendering the grain sizes of the diamond grains and the pitches of the grooves different from each other as described above, and power consumption thereof was compared. A cylindrical grinding machine by Toyota Machine Works, Ltd. was employed as a grinding machine. WA60K (type of JIS) was employed for the conventional grindstones, the outer diameter was 300 mm, and the thickness was 5 mm. The rotational number of the conventional grindstones was set at 1800 r.p.m., and the peripheral speed was set at 28

UNITED STATES PATENT AND TRADEMARK OFFICE

CERTIFICATE OF CORRECTION

PATENT NO. : 6,312,324 B1
DATED : November 6, 2001
INVENTOR(S) : Mitsui et al.

It is certified that error appears in the above-identified patent and that said Letters Patent is hereby corrected as shown below:

Column 28 contd.

m/sec. On the other hand, the rotational number of the diamond rotary dressers was set at 200 r.p.m., and the peripheral speed was set at 1 m/sec. The cutting speed was set at 1 μm/rev. with respect to the conventional grindstones, and the cutting amount was set 0.02 mm. Further, dressing-out was set at 1 sec.

Signed and Sealed this

Twenty-third Day of April, 2002

*Attest:*

*Attesting Officer*

JAMES E. ROGAN
*Director of the United States Patent and Trademark Office*